US007767120B2

(12) United States Patent
Yahata et al.

(10) Patent No.: US 7,767,120 B2
(45) **Date of Patent: *Aug. 3, 2010**

(54) ALIPHATIC POLYESTER MULTI-FILAMENT CRIMP YARN FOR A CARPET, AND PRODUCTION METHOD THEREOF

(75) Inventors: Daisuke Yahata, Toyohashi (JP); Kazuya Matsumura, Ibaraki (JP); Shinnichi Nishihata, Okazaki (JP); Motokatsu Nishimura, Okazaki (JP); Tatsuro Mizuki, Okazaki (JP); Masakatsu Umeda, Yasu-gun (JP); Takehiko Miyoshi, Tokyo (JP); Kenzo Kubo, Ritto (JP)

(73) Assignee: Toray Industries, Inc., Tokyo (JP)

( * ) Notice: Subject to any disclaimer, the term of this patent is extended or adjusted under 35 U.S.C. 154(b) by 871 days.

This patent is subject to a terminal disclaimer.

(21) Appl. No.: 10/815,772

(22) Filed: Apr. 2, 2004

(65) Prior Publication Data

US 2004/0182064 A1 Sep. 23, 2004

Related U.S. Application Data

(62) Division of application No. 10/290,456, filed on Nov. 8, 2002, now Pat. No. 6,740,401.

(51) Int. Cl.

| | |
|---|---|
| ***D01D 5/22*** | (2006.01) |
| ***D01F 6/62*** | (2006.01) |
| ***D02G 1/12*** | (2006.01) |
| ***D02G 1/16*** | (2006.01) |

(52) U.S. Cl. ..... 264/103; 28/263; 28/271; 264/168; 264/210.7; 264/288.4

(58) Field of Classification Search ..... 264/103, 264/168, 210.7, 288.4; 28/263, 271
See application file for complete search history.

(56) References Cited

U.S. PATENT DOCUMENTS

| | | | | |
|---|---|---|---|---|
| 3,781,949 | A | 1/1974 | Breen et al. | |
| 5,348,700 | A * | 9/1994 | Nakamura et al. | 264/210.7 X |
| 6,579,617 | B2 | 6/2003 | Matsui et al. | |
| 6,761,970 | B2 * | 7/2004 | Ochi et al. | 428/364 |
| 6,770,356 | B2 * | 8/2004 | O'Donnell et al. | 428/297.4 |

(Continued)

FOREIGN PATENT DOCUMENTS

| | | |
|---|---|---|
| EP | 0 765 959 | 4/1997 |

(Continued)

OTHER PUBLICATIONS

English translation of JP 2002-105752.

(Continued)

*Primary Examiner*—Leo B Tentoni
(74) *Attorney, Agent, or Firm*—Morrison & Foerster LLP

(57) ABSTRACT

The present invention relates to multifilament crimped yarn comprising an aliphatic polyester and methods for producing thereof, and to carpets that are manufactured by using the crimped yarn. The present invention provides an aliphatic polyester multifilament crimped yarn for the carpets comprising an aliphatic polyester having a melting point of equal to or higher than 130° C., said multifilament crimped yarn having crimp elongation rate of the multifilament crimped yarn after being processed with boiling water of 3-35% and breaking strength of 1-5 cN/decitex.

4 Claims, 4 Drawing Sheets

U.S. PATENT DOCUMENTS

| | | | |
|---|---|---|---|
| 2003/0152743 | A1 | 8/2003 | Matsunaga et al. |
| 2005/0203258 | A1 | 9/2005 | Kimura et al. |

FOREIGN PATENT DOCUMENTS

| | | | |
|---|---|---|---|
| JP | 5-321058 | | 12/1993 |
| JP | 07-011516 | | 1/1995 |
| JP | 8-269834 | | 10/1996 |
| JP | 2000-220032 | | 8/2000 |
| JP | 2000-220054 | | 8/2000 |
| JP | 2002-105752 | | 4/2002 |
| JP | 2002-180340 | A | 6/2002 |
| JP | 2002-227036 | A | 8/2002 |
| JP | 2002-248047 | | 9/2002 |
| WO | WO00/65140 | | 11/2000 |

OTHER PUBLICATIONS

English translation of JP 2002-180340.

Yahata et al., U.S. Office Action mailed Jul. 29, 2003, directed to U.S. Appl. No. 10/290,456; 6 pages.

Yahata et al., U.S. Office Action mailed Dec. 6, 2005, directed to U.S. Appl. No. 10/815,769; 8 pages.

Yahata et al., U.S. Office Action mailed May 3, 2006, directed to U.S. Appl. No. 10/815,769; 8 pages.

Yahata et al., U.S. Office Action mailed Dec. 15, 2006, directed to U.S. Appl. No. 10/815,769; 7 pages.

Yahata et al., U.S. Office Action mailed Sep. 4, 2007, directed to U.S. Appl. No. 10/815,769; 8 pages.

Yahata et al., U.S. Office Action mailed Feb. 13, 2008, directed to U.S. Appl. No. 10/815,769; 7 pages.

Yahata et al., U.S. Office Action mailed Aug. 13, 2008, directed to U.S. Appl. No. 10/815,769; 7 pages.

Yahata et al., U.S. Office Action mailed May 4, 2009, directed to U.S. Appl. No. 10/815,769; 5 pages.

Yahata et al., U.S. Office Action mailed Dec. 24, 2009, directed to U.S. Appl. No. 10/815,769; 9 pages.

* cited by examiner

ALIPHATIC POLYESTER MULTI-FILAMENT CRIMP YARN FOR A CARPET, AND PRODUCTION METHOD THEREOF

REFERENCE TO RELATED APPLICATIONS

This application is a division of Ser. No. 10/290,456, filed Nov. 8, 2002, now U.S. Pat. No. 6,740,401, issued May 25, 2004.

BACKGROUND OF THE INVENTION

1. Technical Field

The present invention relates to multifilament crimped yarn comprising an aliphatic polyester and methods for producing thereof, and to carpets that are manufactured by using the crimped yarn. More specifically, the present invention relates to multifilament yarn which is suitably employed for fibers for carpets, having improved biodegradability in the nature world and having improved mechanical properties such as light fastness, durability, bulkiness and so on, and improved tactile impression, to methods for manufacturing thereof, and to carpets that comprises the crimped yarn.

2. Background Art

Aliphatic polyesters typified by polylactic acid recently attract much attention as materials involving reduced load on the environment. The reasons are: the raw materials thereof do not necessarily require petroleum, and therefore it helps reducing total $CO_2$ emission in view of the production through the disposition thereof; and the material is broken down when it is taken within soil due to its biodegradability, and thus it helps reducing wastes.

Aliphatic polyesters have been used for industries such as agricultural materials, civil engineering materials and so on. Aliphatic polyesters are also employed for fiber materials, and related technologies for obtaining aliphatic polyester fibers by spinning aliphatic polyesters are disclosed (see, for example, Japanese Unexamined Patent Application Publication No. 12-220032, 12-220054 and so on).

On the other hand, a large number of the carpets are used and consumed for helping the comfortable modern life, and also scrapped, and since the carpets are generally bulky and thus difficult to be collected, there are problems of increasing the amount of wastes thereof. Synthetic fibers conventionally used for the carpet such as polyamide fiber, polyolefin fiber, polyester fiber and the like have considerably high durability in the nature environment and are very difficult to naturally broken down, and therefore such fibers have a drawback of semi-permanently remaining unless they are burned.

According to the background described above, an attempt of employing a biodegradable material for the pile of the carpet (see, for example, WO 00/65140 and so on). However, in general, aliphatic polyester multifilament crimped yarn has a tendency of being readily wear out and/or excessively crimped, and when the yarn is thermally processed at higher level during the crimping process for the purpose of obtaining higher crimp, the mechanical strength of resultant yarn is subject to decrease, and therefore it was difficult to be compatible the mechanical strength with the crimp characteristics.

In this reason, multifilament crimped yarn comprising aliphatic polyester having characteristics that include improved bulkiness and improved tactile impression suitable for the carpet has not been obtainable at the present time.

SUMMARY OF THE INVENTION

The object of the present invention is to provide an aliphatic polyester multifilament crimped yarn having characteristics, in which the bulkiness and the tactile sensation suitable for the carpet and the mechanical strength required for the carpet can reconcile, and being biodegradable. In addition, the present invention also provides carpets formed by using thereof and methods for producing thereof.

Specifically, the present invention provides a multifilament crimped yarn comprising an aliphatic polyester having a melting point of equal to or higher than 130° C., and more specifically an aliphatic polyester multifilament crimped yarn for the carpets characterized in having crimp elongation rate of the multifilament crimped-yarn after being processed with boiling water of 3-35% and breaking strength of 1-5 cN/decitex, and carpets manufactured by using thereof, and methods for producing the aliphatic polyester multifilament crimped yarn including a step of providing crimp to drawn multifilament fiber comprising a biodegradable polymer including an aliphatic polyester as a main component by using a crimp-providing apparatus that utilizes heated air.

DESCRIPTION OF THE PREFERRED EMBODIMENTS

Figure 1:
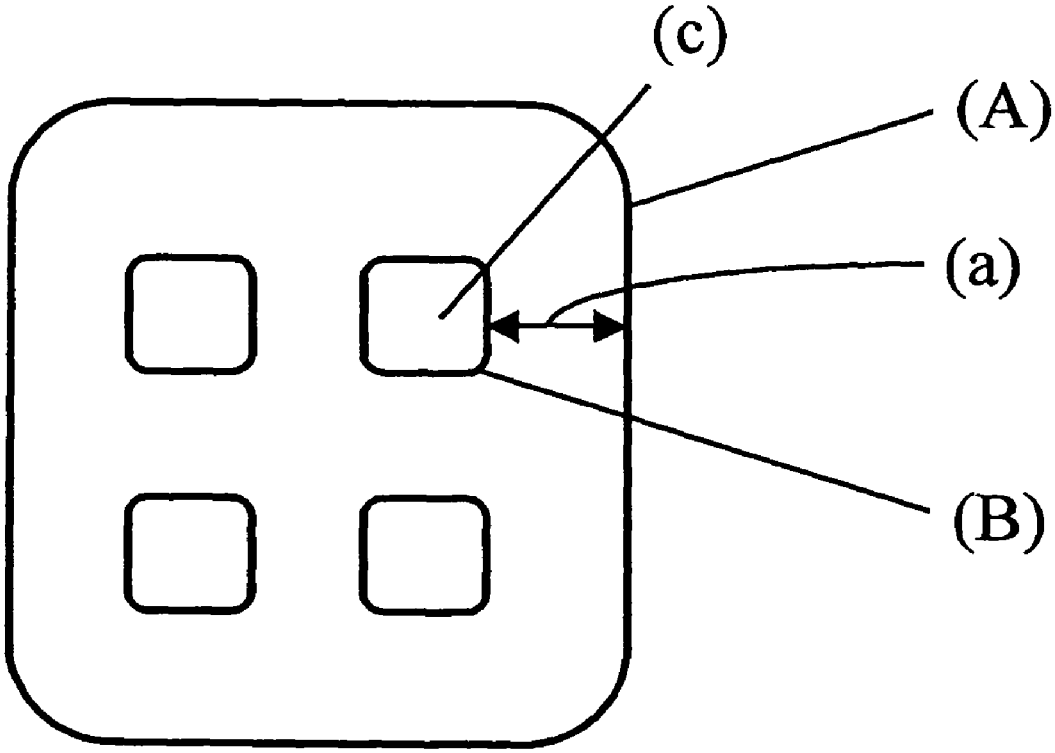
FIG. 1 is a cross sectional view of a hollow nature of the yarn showing a quartered hollow (square hollow) shape.

The aliphatic polyester multifilament crimped yarn for carpet according to the present invention should comprise an aliphatic polyester having a melting point of equal to or higher than 130° C. Aliphatic polyester having melting point of lower than 130° C. may provide products of extremely lower quality level, since insufficient elongation may be caused due to the fusion occurred between single yarns, and melting defect may be occurred during dyeing process, thermal setting process and friction heating process, and therefore it is difficult to employ such type of aliphatic polyester for the application of carpet. The melting point of the aliphatic polyester applicable to the present invention is preferably equal to or higher than 150° C., and more preferably equal to or higher than 160° C. Here the melting point means a peak temperature at a melting peak obtained by a DSC (differential scanning calorimetry) measurement. The (aliphatic polyester employed in the present invention may not be particularly limited provided that the aliphatic polyester have a melting point of not less than 130° C., and more specifically, polylactic acid, polyglycolic acid, poly-3-hydroxy propionate, poly-3-hydroxy butyrate, poly-3-hydroxy butyrate valerate, blended compounds thereof or modified compounds thereof, and the like, can be employed.

These aliphatic polyesters also have advantageous benefits of being decomposed without a difficulty, due to their better biodegradability or hydrolyzability.

Next, the aliphatic polyester multifilament crimped yarn according to the present invention should be one which forms a multifilament crimped yarn, for the purpose of reducing the amount of loose fiber generated on the carpet and improving the durability of the carpet.

For providing a sufficient durability required to the use for crimped yarn for the carpet, the bulkiness is an important performance requirement that affects the quality level of the product. Also, the mechanical strength required by the manufacturing process and/or the durability of the product should be concurrently provided. The index for indicating the bulkiness is the crimp elongation rate after processed with boiling water, and the index for the mechanical strength is the breaking strength.

Accordingly, the multifilament crimped yarn comprising aliphatic polyester employed in the present invention should have an elongation rate after being processed with boiling water of 3-35%, which is considerably critical requirement for using the yarn for the carpet application. More specifically, the crimp elongation rate after processed with boiling water referred in the present description is an index related to a probability or rate of generating a crimp when the yarn is processed within boiling water, and the value of less than 3% provides a condition in which the bulk density of the multifilament yarn remains at lower value even though the yarn is additionally subject to a thermal processing such as dyeing processing, thereby becoming impossible to obtain the pile yarn for the carpet having greater bulkiness, and on the other hand, the value of higher than 35% provides the pile yarn having considerably high bulkiness, but in return, the breaking strength of the fiber is considerably reduced, and therefore defects may occur during passing through the processes and insufficient durability for use may occur.

Here, the crimp elongation rate after being processed with boiling water referred in the present description can be specifically measured according to the following method.

[Crimp Elongation Rate After Being Processed With Boiling Water]

A crimped yarn raveled out from a package that was left for more than 20 hours within an atmosphere of a temperature of 25-35° C. and a relative humidity of 50-75% is immersed and processed within boiling water without exerting any load for 30 minutes, and then the yarn is dried to a level of an equilibrium moisture regain to obtain a sample for a crimped yarn after processed with boiling water. The sample yarn is subject to an initial load of 2 mg/denier, and after continuing for 30 seconds, the point corresponding to a sample length of 50 cm (L1) is marked. Then a constant load of 100 mg/denier is exerted to the sample yarn, and after continuing for 30 seconds, the elongated sample length (L2) is measured. The following equation will give a crimp elongation rate (%)

$$\text{crimp elongation rate (\%)}=[(L2-L1)/L1]\times 100$$

In this case, the above condition of the atmosphere for leaving the yarn before the processing with boiling water is set for obtaining a condition of the crimped yard during the actual manufacturing process of the carpet, or in other words the condition of achieving equilibrium of the crimp characteristics by absorbing moisture, and therefore the above condition is selected in view of achieving equilibrium within not very long time and without causing condensation of water.

Next, the breaking strength of the aliphatic polyester multifilament crimped yarn for carpet according to the present invention should be 1-5 cN/decitex as measured in the method described later, in view of achieving better processibility of a high order appropriate for use in the carpet. The reason for preferably having the breaking strength of 1-5 cN/decitex is that the breaking strength of less than 1 cN/decitex may be a cause of stopping the manufacturing machine by thread breakage during the tufting or weaving, and may cause reduction of the product strength due to reduction of tear strength of tufted fabrics, cloths and/or knitting fabric. On the other hand, if one is willing to obtain a yarn having a breaking strength of higher than 5 cN/decitex, it is necessary to carry out manufacturing of the multifilament at considerably higher elongation rate, or to carry out the crimp process at considerably lower temperature in order to maintain the breaking strength of the elongated yarn, and thus problems on the manufacturing aspect and/or on the quality aspect such as defects of the manufacturing-ability or difficulty in obtaining a target yarn having larger bulk density will occur for both cases, and thus not preferable.

The aliphatic polyester employed in the present invention may preferably have a refractive index of the polymer of equal to or less than 1.5. The refractive index is, more preferably, equal to or less than 1.45. This provides aliphatic polyester multifilament crimped yarn for the carpet having better luster and better color development.

Here, the refractive index contained herein means a value obtained by a measurement according to a method of JIS K-7105 by using an Abbe's refractometer having a prism which is installed in a well-natural lighted room and which is adjusted at 23° C. by a means such as circulator of constant temperature water.

The aliphatic polyester multifilament crimped yarn for carpet according to the present invention may be a hollow fiber having at least one hollow section within the cross section of the single yarn. In this case, the respective aliphatic polyester hollow cross-sectional yarn may have a thickness consisting of a distance between the outer circumference thereof and the contour of the hollow section of not less than 3 μm, and preferably not less than 5 μm. The distance therebetween is a critical requirement for preventing damages due to the breaking and/or crushing of the hollow section when using the aliphatic polyester yarn for the face yarn of the carpet, and the thickness of not less than 3 μm, and preferably not less than 5 μm, may provide aliphatic polyester yarn that is free of damage for a longer term use. Designing the yarn to be the hollow fiber provides the aliphatic polyester multifilament crimped yarn having better bulkiness and lightweight.

Also, the hollow cross section can create a reflection of the visible light at a random reflection angle, thereby preventing color rendering properties caused by an orientation of the piles of the manufactured carpet therewith. Here, the thickness consisting of the distance between the outer circumference of the hollow cross sectional yarn and the contour of the hollow section thereof means, for example for a yarn having a hollow cross sectional shape of a quartered hollow shape, a thickness (a) consisting of a distance between an outer circumference (A) of a single yarn and a contour of the hollow section (B) as shown in FIG. 1.

Figure 2:
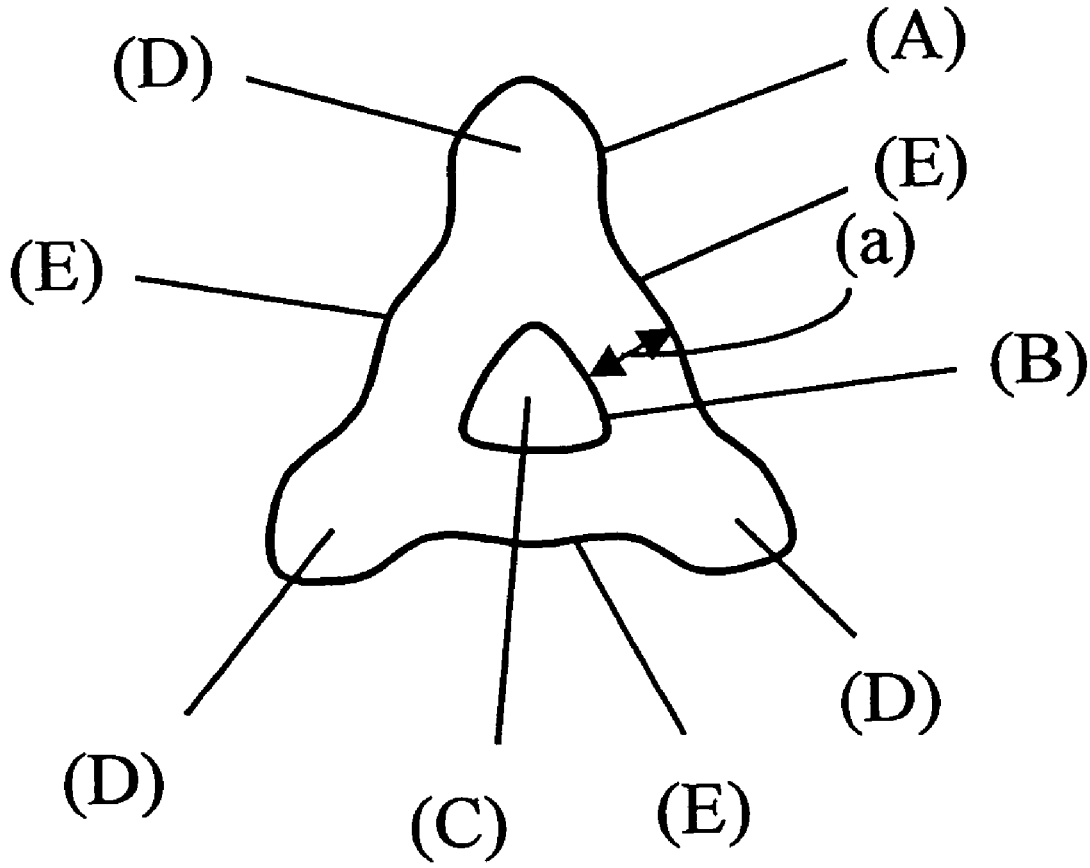
FIG. 2 is a cross sectional view of a hollow nature of the yarn showing a triphyllous (trilobal) shape.

Similarly, the thickness also means, for a yarn having a hollow cross sectional shape of a triphyllous shape, a thickness (a) consisting of a distance between an outer circumference (A) of a single yarn and a contour of the hollow section (B) as shown in FIG. 2.

The thickness (a) of less than 3 μm may cause a considerable decrease of a resistance to compressive fatigue and/or thermal resistance and weatherability, and therefore the yarn having such thickness is not suitable for application of the face yarn for carpet, and thus not preferable.

Further, an areal occupied rate of the yarn cross section occupied by the hollow section (hollow rate) of the aliphatic polyester hollow cross sectional yarn according to the present invention is not particularly limited, but the 5-20% is preferable in consideration of the weight saving and the deglossing effect.

The single yarn cross sectional shape of the aliphatic polyester multifilament crimped yarn according to the present invention may preferably be any modified shape such as polyphyllous shape, crossing shape, curb shape, W-shape, S-shape, X-shape and the like. Having these cross sectional shape provides the yarn having higher bulk density than fibers having a circular cross section manufactured by being extruded through a circular die. The bulk density is a critical requirement for the pile yarn for carpet. Among these shapes, the polyphyllous shape is preferable due to the fibril resistance. Also, having a heteromorphic cross section of the single yarn cross sectional shape provides fibers having better luster.

When the shape of the single yarn cross-section is designed to be a polyphyllous shape, the number of the foliate may preferably be three, that is the shape may be a triphyllous cross section. Having the triphyllous cross section provides higher bulk density without adversely affecting productivity thereof.

Further, in order to obtain improved bulk density, the aliphatic polyester multifilament crimped yarn may have a triphyllous and hollow cross sectional shape, in which the cross sectional shape of a single yarn is the above noted triphyllous shape, and has one to three hollow sections therein.

More specifically, FIG. 2 illustrates an example of the above-mentioned single yarn having the triphyllous and hollow cross sectional shape, and FIG. 2C shows the hollow sections, FIG. 2D shows three convex portions, and FIG. 2E shows three concave portions.

Having a shape having convex portions (FIG. 2D) and concave portions (FIG. 2E) provides larger cross sectional secondary momentum of the aliphatic polyester hollow cross sectional shaped single yarn, thereby improving retrieval from a flexure. Further, since the configuration provides increased dimension occupied by each of the single yarn, the face yarn having improved resilience-sensation and coverage can be obtainable.

Concerning the above-mentioned convex portions (FIG. 2D) and concave portions (FIG. 2E), it is the most practicable to provide three of these portions, respectively, i.e., to provide the triphyllous and hollow shape shown in FIG. 2, in consideration of the advantageous effect thereof and the facility in forming yarn by melting aliphatic polyester and forming the heteromorphic cross section.

In addition, the aliphatic polyester multifilament crimped yarn may be one having a cross section of a polyphyllous shape including four to eight phylloids. Polyphyllous shape having not less than nine phylloids is not practicable, since there is not a significant difference between the yarn having the cross sectional shape and a yarn having a circular cross section, thereby leading diminishing the advantageous effect of the present invention.

Further, the aliphatic polyester multifilament crimped yarn may be a quartered hollow cross sectional fiber, in which four hollow sections are included in the axial cross section of the single yarn. FIG. 1 illustrates an example of the quartered hollow cross sectional single yarn, in which (C) indicates the hollow sections. The quartered hollow cross sectional yarn includes four hollow sections in which two hollow sections are disposed in two rows. This configuration provides carpets having improved bulk density and stain resistance, and thus preferable. This is because the quartered hollow cross sectional fiber includes no concave portion, and thus an accumulation of stain can be prevented, while the polyphyllous shaped fiber has concave portions in which stains are easily accumulated.

The effect of having heteromorphic cross section of the single yarn axial cross section my considerably appear if a heteromorphic level (D/d), that is obtained by dividing a diameter (D) of the outer circumscribing circle of a single yarn axial cross section by a diameter (d) of an inner inscribing circle of the single yarn axial cross section, is within a range of 1.1-8. The above noted value (D/d) of less than 1.1 causes substantially the same as using a circular cross sectional fiber that is produced by being extruded through a circular die, and on the other hand the value (D/d) of higher than 8 causes problems such as fibrillating and the like, and thus causing insufficient tuftability and weaveability, which are related to the following processing of the manufacturing process of the carpet.

According to the present invention, the value (D/d) of 1.3-5 provides a considerable effect of the present invention, and thus preferable.

Further, when the single yarn cross section has four to eight phylloids, a value [(h/L)×100], which is obtainable by dividing a length (h) of a perpendicular line from a point in a tangential line contacting both of adjacent convexes to a most concave portion by a length (L) of the tangential line between the adjacent convexes, is preferably 2-30. The larger the value [(h/L)×100] is, the higher the luster of the fiber is obtained. More preferably, the value [(h/L)×100] is 5-30.

Figure 3:
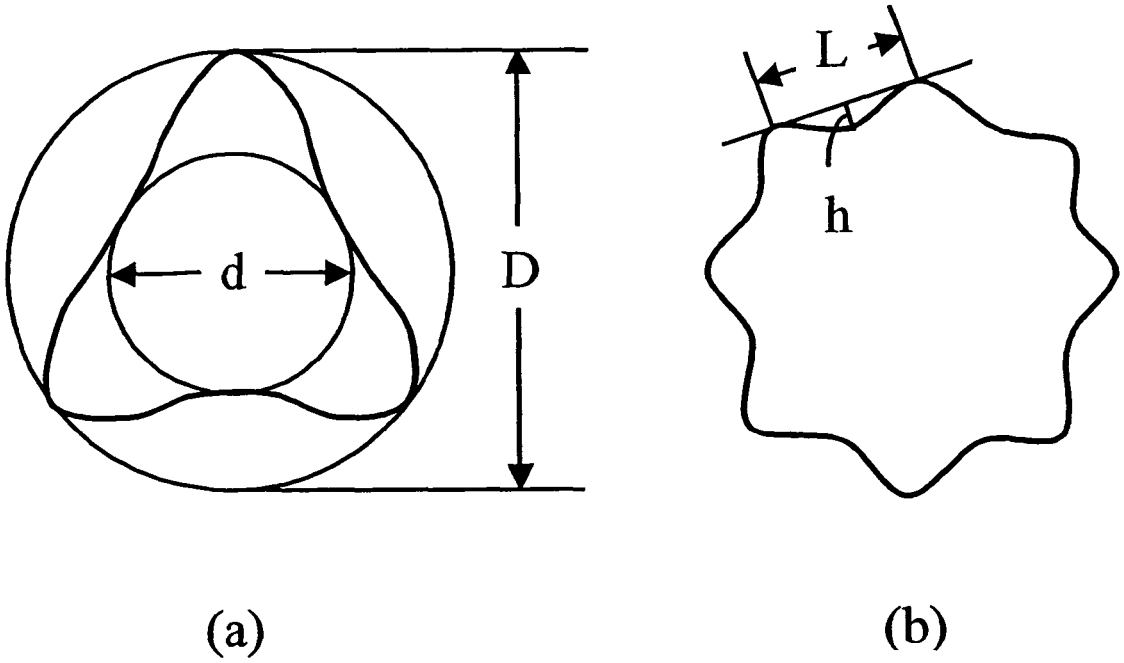
FIG. 3 is a diagram showing the dimension for evaluating heteromorphic level of the yarn having a heteromorphic cross section.

FIG. 3 is a schematic diagram illustrating a cross sectional shape of a aliphatic polyester multifilament crimped yarn for carpet according to the present invention. FIG. 3A shows a triphyllous shaped cross sectional fiber, FIG. 3B shows octaphyllous shaped cross sectional fiber, and a manner for considering the above indicated values D, d or h, L is shown therein.

The aliphatic polyester according to the present invention provides comfortable softening sensation, unlike fibers comprising the aromatic polyesters. The comfortable softening sensation is due to the lower Young's modulus of the present fiber that is definitely lower than that of aromatic polyester fibers. Meanwhile, in order to fully achieve the desired advantageous effect of the present invention to use the fibers for carpet applications, the fineness of the single yarn should be 3-35 decitex, and more preferably 8-25 decitex. A single yarn having a fineness of higher than 35 decitex provides larger compressive resilience even though the yarn is a aliphatic polyester yarn, and therefore the texture of the carpet becomes too hard and the precious soft characteristic thereof becomes ineffective, and thus providing a feeling-harsh product which is not preferable. Further, a single yarn having a fineness of less than 3 decitex provides a soft feel of the product, but the durability of the fiber against the load and/or the friction decreases, and thus providing non-wearing products, and thus not preferable. Needless to say, denier-mixed filament blended yarn of lower fineness yarn and higher fineness yarn can be employed, as long as an average single yarn fineness of a multifilament is within the above-described fineness range.

The preferable polymer in view of achieving high melting temperature and low refractive index according to the present invention includes polylactic acid that is a polyester containing L-lactic acid as a main component, and polyglycolic acid that is a polyester containing glycolic acid as a main component.

Here the term "containing L-lactic acid as a main component" means that not less than 60% wt. of the whole contents consists of L-lactic acid, and the polymer may be polyester containing D-lactic acid within a range of not exceeding 40% wt.

The following production methods of polylactic acid are known: two-step lactide method, in which lactide, a cyclic dimer, is first produced from lactic acid as a raw material acid and then ring opening polymerization is carried out; and single-step direct polymerization method, in which direct dehydrocondensation of lactic acid as a raw material is carried out. The polylactic acid according to the present invention may be produced in either of these methods. In the case of employing polymer obtained by the lactic method, the contents of cyclic dimer in the polymer is preferably not larger than 0.3% wt. in the stages before the melting fiber spinning, since the cyclic dimer contained in the polymer is vaporized during the melting fiber spinning process to cause patch in the yarn. The direct polymerization method is substantially free of the problem caused by the cyclic dimer, and therefore more preferable in view of the manufacturing-ability of the yarn.

Higher number average molecular weight of polylactic acid is more preferable, and the number average molecular weight is commonly at least 50,000, preferably at least 100,0000, and more preferably 100,000-300,000. Lower average molecular weight of less than 50,000 causes decrease of the mechanical strength of the fiber, and thus not preferable.

In addition, polylactic acid according to the present invention may include co-polymer polylactic acid formed by copolymerizing L-lactic, acid, D-lactic acid, and other components having an ability of forming esters. Other components having an ability of forming esters includes: hydroxy carbonic acid such as glycolic acid, 3-hydroxy butyric acid, 4-hydroxy butyric acid, 4-hydroxy valeric acid, 6-hydroxy caproic acid and the like; compounds, or derivatives thereof, including a plurality of hydroxyl group in the molecular, such as ethylene glycol, propylene glycol, butane diol, neopentyl glycol, polyethylene glycol, glycerin, pentaerythritol and the like; and compounds, or derivatives thereof, including a plurality of carboxylic acid in the molecular, such as adipic acid, sebacic acid, fumaric acid, terephthalic acid, isophthalic acid, 2,6-naphthalene dicarboxylic acid, 5-sodium sulphon isophthalate, 5-tetrabutyl phosphonium isophtalate and the like.

In addition, in order to decrease the melt viscosity, aliphatic polyester polymers such as polycaprolacton, polybutylene succinate and polyethylene succinate can be used for an internal plasticizer or an external plasticizer. Further, inorganic particles or organic compounds may be employed as required for applications such as deglossing agents, deodorant agents, fire retardant agents, yarn friction decreasing agents, antioxidant agents, coloring pigments and the like.

Also, the aliphatic polyester multifilament crimped yarn for carpet according to the present invention may preferably have total fineness for the multifilament crimped yarn of 500-5,000 decitex measured according to the method described later, and boiling water shrinkage of not higher than 10%, in view of obtaining suitable higher order processibility for the carpet application.

The above-mentioned total fineness of lower than 500 decitex causes necessity of increasing density of the tufted fabrics during the processing of the carpet, thereby increasing the cost for processing, and on the other hand, the total fineness of higher than 5,000 decitex requires the complicated procedure of treating the tufted fabrics, thereby unserviceable and thus not preferable. Setting the total fineness within the above-indicated preferred range provide maintaining the production efficiency in the twisting process, setting process or tufting process, and thus it is possible to twist two or three colored yarn that are differently colored to practically obtain highly colored and highly luster carpet in a simple way.

Also, setting the boiling water shrinkage of not greater than 10% decreases the shrinkage after the hot water processing such as refining or dyeing to promote the tentering of the carpet, and thus preferable. On the contrary, the boiling water shrinkage of greater than 10% cause increase of the shrinkage after the hot water processing such as refining or dyeing to adversely affect the tentering of the carpet and to tend providing hard texture, and thus not preferable.

Next, the aliphatic polyester yarn may preferably include coloring agent in the yarn of 0.02-3% wt., preferably 0.3-1% wt., in view of directing cost reduction for the manufacturing process of the carpet using thereof, and in particular for requirement of free of dye, or for preventing the change of the physical properties due to the dye.

However, the additional amount of the coloring agent of higher than 3% wt. may have a tendency to cause problems such as inducing the thread breakage during manufacturing process of the filament, or causing the decrease of viscosity of aliphatic polyester. In addition, the amount of less than 0.1% wt. may cause defects such as causing uneven coloring or hue of the filament, or too weak hue.

An example of pigments for constituting the coloring agents available for the present invention includes: carbon black; anthraquinone pigments; dioxazine pigments; phthalocyanine pigments; perylene pigments; condensed azo pigments; thio indigo pigments; titanium dioxide; and iron oxide pigments, and among these it is preferable to use carbon black in the components of the coloring agent, in view of the cost of the coloring agent, productivity of the yarn, and accommodation of disposition after used as a carpet face yarn. Type of carbon black contained in the agent is not particularly limited, and carbon black having a particle size of not larger than 1 μm within the fiber is preferable, and carbon black having a particle size of not larger than 0.1 μm is more preferable. In addition, pigments such as: copper phthalocyanine blue having number of substituting chlorine atom of 1; phthalocyanine blue pigments; pigment blue 15 and so on are available to be used for coloring auxiliary agents.

The applicable method of adding these coloring agents includes: method of blending thereof during chip drying process and carrying out spinning thereafter; method of directly adding the coloring agent during the spinning process; method of melting master chip including the concentrated coloring agent and blending the master chip with a base polymer that has been separately melted and thereafter carrying out spinning (melt blend method); method of blending master chip including the concentrated coloring agent and base chip and carrying out spinning thereafter (chip blend method); and the like, and among these the methods of using master chip are particularly effective, in view of stability of the product's quality, stability of the operation, production cost and the like.

Next, aliphatic polyester yarn according to the present invention may preferably have retention of the breaking strength after leaving 200 days in the condition of the after-mentioned 20° C.×65% RH condition of equal to or higher than 80%, and more preferably equal to or higher than 90%.

In the case of having less than 80% of the retention of the breaking strength, thread breakage and fibrillating during the storage or during the carpet manufacturing process due to the decrease of breaking strength, thereby causing problems on the production and/or quality, and thus not preferable. And this is not preferable for the duration of the products.

Specific method for obtaining the retention of the breaking strength of not less than 80% includes using non-aqueous oil solution or employing pressurized air for heating medium during crimping. Preventing addition of moisture during the production process provides inhibition of hydrolysis, thereby achieving the retention of the breaking strength of not less than 80%, though details will be described later.

The aliphatic polyester multifilament crimped yarn for carpet according to the present invention may preferably have the after-mentioned yarn-metal kinetic friction coefficient of not higher than 0.4, in view of the improving passing-ability during the carpet production process in which the yarn is used, or improving wear resistance of the products. More preferably, the friction coefficient is not higher than 0.35. Satisfying this condition prevents the melting and fusion of the aliphatic polyester fiber for carpet during passing through the production process due to the friction between the yarn and the metal.

The method for obtaining the yarn-metal kinetic friction coefficient of not higher than 0.4 is not particularly limited, and this value can be achieved by decreasing the orientation of the surface layer portion via thermal processing of the yarn surface, or by adding the oil solution that reduces the yarn-metal kinetic friction coefficient. Also, an additional agent for reducing the yarn-metal kinetic friction coefficient may be added thereto in a separate process. Among these, the method of adding the oil solution that reduces the friction is preferably employed, in view of providing better operate ability and achieving uniform processing. The adherence of the additive oil solution is preferably 0.1-2% wt., and more preferably 0.3-0.7% wt. Adherence of less than 0.1 wt. provides smaller reduction of the kinetic friction coefficient by the oil solution, and thus not preferable. On the other hand, adherence of more than 2% wt. of the oil solution does not provide significant increase of the reduction of the friction and production cost increases, and thus not preferable.

The oil solution itself as a concentrate solution may be used by being diluted with a diluent such as low-viscous mineral oil, and the dilution rate thereof may be commonly 10-80% wt., and preferably 20-70% wt.

The oil solution mainly comprises a smoother agent, an extreme-pressure agent and a surfactant component, and each of the components may be selected to provide lower friction of the yarn-metal kinetic friction coefficient. The smoother agent component of the oil solution for reducing friction is preferably a polyester smoother agent, and more preferably a polyether polyester. When polyether polyester is selected for the smoother agent, average molecular weight thereof may preferably be 2,000-15,000, and more preferably 3,000-10,000, and an esterified compound obtainable from a diol compound of polyether and a aliphatic carboxylic acid (except for esterified compounds obtainable from poly tetra methylene glycol having an average molecular weight of 600-6,000, dibasic acids and monohydric fatty acids) may preferably be employed. Among these polyether polyesters, compounds having the both ends that are closed by esterification of monohydric fatty acid, such as compounds in which both ends of dibasic acid are esterified with ethylene oxide and/or propylene oxide and further the both ends are esterified with monohydric fatty acid, are particularly preferable.

The polyether polyester having excessively smaller average molecular weight of less than 2,000 causes insufficient strength of the oil film, and the polyether polyester having average molecular weight of higher than 15,000 causes a tendency of providing insufficient improvement if the friction properties.

In addition, the polyether component comprised of the polyether polyester may preferably be a polyether that is a polymer of ethylene oxide and/or propylene oxide and that preferably has an average molecular weight of 600-6,000, and more preferably 800-4,000. The excessively low average molecular weight of less than 600 may cause insufficient strength of the oil film, and average molecular weight of higher than 6,000 may provide excessively higher friction properties.

Here the term average molecular weight in the present invention means the number average molecular weight measured by using GPC (gel permeation chromatography) and the like.

Further, carboxylic acid comprised of the polyether polyester may preferably be an aliphatic carboxylic acid. When a dibasic acid and a monobasic acid are combined to be used, at least one of both is or preferably both are aliphatic fatty acid. The above-indicated smoother agent component is employed by; itself or by combination of tow or more agents so that the smoother agent is included at 30-100% wt. of the processing agent, but other agents than the above-indicated smoother agent such as an extreme-pressure agent component, a surfactant component and so on, and the total amount of these components may be included at 70% wt. at most.

The other components for the smoother agent may include: mineral oils such as refined spindle oils, liquid paraffins and so on; vegetable oils such as palm oil, castor oil and so on; higher fatty acid esters such as isostearyl laurate, oleyl oleate, dioleyl adipate and so on; alkyl ether ester such as laurylate of lauryl alcohol having additional 2 moles of ethylene oxide (EO), laurylate of tridecyl alcohol having additional 3 moles of EO and so on; waxes and the like, and among these, aliphatic ester and a alkyl ether ester are preferably used. The rate of the smoother agent included therein may be 5-30% wt. and more preferably 10-20% wt.

The extreme-pressure agent component is a components having an effect of increasing oil film strength of the processing agent, and includes, for example: aliphatic soaps such as oleic acid soap, erusic acid soap and so on; organic phosphate salts such as lauryl phosphate potassium salt, oleyl phosphate sodium salt and so on; organic sulfonate salt such as dodecyl benzene sulfonate sodium salt and so on.

When the extreme-pressure agent component is blended therein, the rate of blending is preferably 0.02-10% wt. and more preferably 1-5% wt. The rate of blending of less than 0.02% may cause insufficient effect of improving the oil film strength. Also, the rate of blending of higher than 10% wt. may cause increase of the viscosity, thereby deteriorating the slipping ability.

Also, the surfactant component may include: alkylene oxide-adduct products of higher alcohols (such as ethylene propionic oxide-adduct products of octyl alcohol, ethylene propionic oxide-adduct products of stearyl alcohol, ethylene oxide-adduct products of oleyl alcohol and so on); alkylene oxides-adduct products of polyalcohol esters (such as ethylene oxide 25 mole-adduct products of castor oil, ethylene oxide 20 mole-adduct products of sorbitan trioleate and so on).

When the surfactant component is blended therein, the rate of blending is preferably 5-20% wt. and more preferably 10-15% wt.

Further, other components such as: pH adjusters such as alkali metals, alkylene oxide-adduct products of alkyl amines; antioxidant agents; ultra violet absorbents; fluoro-compounds and so on, may be blended as required.

When the pH adjuster is blended therein, the rate of blending is preferably 0.02-10% wt. and more preferably 0.03-8% wt. When the other component is blended therein, the rate of blending them is preferably 0.02-10% wt. and more preferably 0.03-5% wt.

Next, for the carpet according to the present invention is manufactured by using aliphatic polyester multifilament crimped yarn for carpet comprised of multifilament crimped yarn having a melting point of not lower than 130° C., characteristic in that the crimp elongation rate of the multifilament crimped yarn after being processed with boiling water is 3-35%, and that the breaking strength is 1-5 cN/decitex, and therefore carpets having improved-hue, improved luster, improved bulkiness and suitable softening sensation can be obtainable.

Here, fabricating method for the carpet according to the present invention is not particularly limited, and various types of carpet such as: woven carpets such as, for example, cotton carpet, Wilton carpet, face-to-face carpet, Axminster carpet and so on; embroidery carpets such as tufting carpet, hook drag carpet and so on; adhesive carpets such as bonded carpet, electrodeposited carpet, cord carpet and so on; knitted carpets such as knitted carpet, raschel carpet and so on; and carpet having piles typically including compressed carpet such as needle punched carpet, and combination thereof can be employed, and among these, the tufting carpet comprising at least face yarn of pile fiber, base cloth in which the face yarn is tufted, and backing material adhesive to the backside of the base cloth is preferable, in order to obtain carpets having hefty sensation with lower cost.

Further, the preferable tufting carpet for improving the effect of reduced load on the environment can be presented by using aliphatic polyester fiber for a part of, and preferably not less than 50% of, the base material and the backing material.

The intended use of the above-mentioned carpet having improved softening sensation, improved luster, improved bulkiness and biodegradability is not particularly limited to a specific application, and the carpet can be set for various purposes and on the various locations including, for example: for accommodation purposes such as living room, kitchen, entrance, dust control, balcony and so on; for commercial purposes such as office, school, art museum, theater, hotel, restaurant, bank, department store, retailer's store and so on; for transportation purposes such as train, car, bus, ship, aircraft and so on; for indoor/outdoor sports purposes such as athletics stadium, baseball park, golf course, fitness club, poolside and so on.

Further, conformation of face yarn of the carpet according to the present invention is not particularly limited: and for example, cut pile yarn, loop pile yarn or combination thereof can be employed; twisted yarn of a plurality of aliphatic polyester multifilament crimped yarn according to the present invention can also be employed; and further, combination thereof with other fibers or material's can also be employed as long as the advantageous effect obtainable by using the aliphatic polyester multifilament crimped yarn according to the present invention is not spoiled.

Further, when the aliphatic polyester multifilament crimped yarn is composed from an aggregation of a hollow cross sectional single yarn, the carpet of the present invention having face yarn of the multifilament crimped yarn may possess the function that can achieve considerably high bulkiness and wear resistance and that can provide weight saving, and may create extremely low harmful effect to the environment when it carpet is disposed after use.

In general, aliphatic polyesters are the material having considerably higher level of biodegradability, and the material is naturally broken down when it is taken within soil, and thus it helps reducing load onto the environment.

Thus, when coloring agent is included in the aliphatic polyester multifilament crimped yarn according to the present invention, carbon black coloring agents may preferably be used in view of reducing the load onto the environment.

The multifilament crimped yarns of aliphatic polyesters according to the present invention and the methods of producing the carpet by using the crimped yarn will be described as follows.

The aliphatic polyester multifilament crimped yarn according to the present invention is basically produced by melt spinning method comprising melting process, spinning process, cooling process, lubrication process, drawing process and crimping process.

In the crimping process, yarn is crimped by using a crimping machine. The yarn may be crimped via a general heated fluid processing, and various types of crimping methods such as jet nozzle type, jet stuffer type or gear type of methods can be employed, an among these the jet nozzle type method may be preferably employed for the purpose of obtaining higher level of crimping and actualization thereof, and a crimping nozzle described in U.S. Pat. No. 3,781,949, for example, may be preferably used.

The heated fluid used in the heated fluid processing should be a heated air. Commonly, superheated steam is often used for its lower cost, but the superheated steam is not preferable since moisture contained in the steam is absorbed into the aliphatic polyester multifilament crimped yarn to promote hydrolysis of the aliphatic polyester, thereby contributing degradation the durability of the product, in particular reduction of the retention of the breaking strength. Using heated air containing lower amount of moisture provides preventing promotion of hydrolysis thereof to achieve the production of aliphatic polyester multifilament crimped yarn for carpet having higher retention of breaking strength.

The temperature of the heated fluid that thermally contacts the yarn is preferably 100-200° C. More preferably, the temperature is 120-170° C. Excessively higher temperature is not preferable since it causes fusion bonding of the single yarn or reducing the breaking-strength of the crimped yarn.

In this case, a cooling apparatus, and/or rotary filter, can be employed for the purpose of stabilizing the crimp, as described in Japanese Unexamined Patent Application Publication No. 05-321058.

It may be essential to suitably set a condition for crimping in order to obtain the desired physical properties thereof, since the crimp elongation rate after being processed within boiling water and the breaking strength thereof are substantially fixed at this stage of crimping.

Next, the drawing process may include drawing the yarn to a scale of 1.02-9 times, and the drawing process may preferably be carried out by two steps of: drawing the yarn to a drawing scale of 1.01-3 times in first step; and drawing the yarn to a drawing scale of 1.01-3 times, thereby providing 1.02-9 times in total. A drawing process that is carried out in a single step is not preferable because the single step drawing may cause thread breakage or carding during the drawing process to lead reducing the processibility, and further not preferable in view of the product quality because reduction of the breaking strength and quality of the products.

In addition, two-step drawing process provides the aliphatic polyester multifilament crimped yarn having stable quality while being available of being drawn at higher drawing scale. Crimping the aliphatic polyester multifilament crimped yarn drawn at a higher scale provides a state of high orientation and high crystallinity. This, in turn, enables the yarn having higher crimp elongation rate. It is preferable for the aliphatic polyester multifilament crimped yarn according to the present invention to carry out the drawing of the yarn at a scale of 1.5-6 times, since the aliphatic polyester multifilament crimped yarn of the present invention requires to have certain levels of orientation and crystallinity for providing the crimped yarn having suitable breaking strength that are suitable to the carpet application in the later processing steps and higher crimp level. Carrying out at excessively higher scale of drawing may cause-undesirable results such as fibrillating at later processing steps.

Further, the drawing process may be carried out by additionally using steam processing apparatus for the purpose of subsidiarily fixing a elongation point.

The above-indicated melt spinning process and drawing process, and further the crimping process may be continuously carried out without taking-off process in the mid-course thereof, or may be carried out with interrupting the process for taking-off process at the non-drawn yarn stage or at the drawn yarn stage, and among these, the process is preferably continuously carried out to proceed to the crimping process without an interruption for taking-off in the mid-course thereof. The hydrolysis of polyester depends on the thermal history thereof, it is preferable to transfer heat transferred to the yarn at as small quantity as possible. In consideration of this aspect, carrying out continuously these processes may reduce the heat quantity transferred to the yarn. On the contrary, when the processes are separately carried out and a taking-off process is inserted in mid-course, re-heating of the aliphatic polyester multifilament crimped yarn prior to the subsequent process is required, and thus not preferable.

Further, the drawing process is preferably carried out by drawing a non-drawn multifilament yarn comprising a biodegradable polymer may mainly consist of aliphatic polyester as a main component after pre-heating the filament at a temperature ranging from a glass transition temperature thereof to a temperature of 80° C. higher than the glass transition temperature. Insufficient pre-heating may provide drawing the yarn at a condition of insufficiently melting of the polymer, and therefore may cause carding and thread breaking by breaking the single yarn to lead deterioration of the productivity and the quality of the product, and thus not preferable. In order to carry out the sufficient pre-heating, the preferable manner is to use a Nelson roller.

Before drawing the melt-spun non-drawn multifilament yarn, lubrication process is implemented. Known oil solutions may be available for the oil solution of the present invention, and the oil solution may preferably be added to the yarn in a form of non-aqueous solution having a lower evaporation latent heat, for the purpose of preventing deterioration of the physical properties by time due to the hydrolysis of the aliphatic polyester and smoothly carrying out the pre-heating in the subsequent drawing process. The characteristics of aliphatic polyester includes the hydrolysis ability due to its biodegradability, and applying the oil solution of non-aqueous solution prevents promoting the hydrolysis ability thereof due to addition of an excessive water to the aliphatic polyester fiber. When the oil solution is applied with an ordinarily used emulsion solution, hydrolysis thereof is promoted, and the deterioration of the physical properties of the fiber, and in particular the retention of the breaking strength, is induced, and thus not preferable. In addition, when the method for satisfying the yarn-metal friction coefficient of the present invention by using the oil solution is employed, it is preferable to select the oil solution for obtaining the above-mentioned lower friction depending on the properties such as viscosity and so on of polymer for use.

The lubricating process is preferably carried out before the drawing process. Lubricating prior to the drawing process may prevent causing carding due to the friction during the drawing process, and thus improving the quality of the product. The method of lubricating is not particularly limited, and suitably selected from methods such as guiding lubrication, mist lubricating, lubrication by using a roller and so on if necessary.

The melt spinning machine available for producing the fiber according to the present invention may be an extruder spinning machine or a pressurizing spinning machine, and among these the extruder spinning machine is preferable in view of obtaining uniform quality of the product and higher yield during the spinning process. The process may be carried out, in which base chips of aliphatic polyester is first fed to the spinning machine to obtain the melted aliphatic polyester, and the material is melt-extruded through the die to obtain a non-drawn multifilament.

In this case, when property stabilizing agents such as weatherability stabilizing agent and so on are included in the yarn, the adding process may be carried out before spinning process, and the method of adding these agents may be selected according to the type and the characteristics of compounds of the agent.

Also, when the coloring agent is included in the aliphatic polyester, a master chip containing the coloring agent is prepared in advance, and the master chip can be added and mixed to the base chip just before the spinning process. For example, an aliphatic polyester master chip containing equal to or higher than 5% wt., preferably equal to or higher than 10% wt., of the coloring agent may be mixed to the above-indicated aliphatic polyester base chip so that the mixing amount thereof is calculated and measured to provide the concentration of the coloring agent within the aliphatic polyester yarn of within a range of 0.02-3% wt.

Further, the yarn cross section of the aliphatic polyester fiber can be designed to be the aforementioned heteromorphic cross section, the aforementioned single yarn fineness, and aforementioned total fineness by suitably selecting the condition of the spinning process such as shape of discharging aperture of the die for melt-discharging, taking-off speed and so on, corresponding to the purposes. For example, when a triphyllous shape is preferable to be obtained, a die having a discharging aperture of "T"-shape or "Y"-shape may be used. Also, in order to obtain the larger value of the aforementioned (D/d) that represents the heteromorphic level, a method of setting smaller the die surface depth or a method of improving the cooling can be employed. Further, when the hollow cross sectional yarn, a hollow cross sectional die can be used.

The drawing of the aliphatic polyester polymer at higher scale may cause carding or thread breaking thereof, and thus the orientation may preferably be proceeded to a suitable level before carrying out the taking off.

The preferable taking-off speed for simultaneously satisfying both the breaking strength and the crimp elongation rate may be 400-2,000 m/min.

The yarn is processed through the drawing process and the crimping process, and the crimped yarn is then cooled and thereafter pulled so as not to deteriorate the crimp, and eventually taken-off to a package. Leaving the aliphatic polyester multifilament crimped yarn in a condition of being pulled at a certain tensile force for a certain amount of time may cause reduction of the breaking strength and the tensibility of the yarn, depending on the effect of the used lubricant or on the effect of the atmospheric environment of the storage. In this reason, excessive pulling of the yarn is not desirable, and thus the winding tensile force of less than 0.1 cN/decitex is commonly employed. This provides an achievement of the breaking strength and the crimp elongation rate after being processed with boiling water of the present invention, and in addition, the aliphatic polyester multifilament crimped yarn having retention of breaking strength of equal to or higher than 80% for the case in which the yarn is stored in the winded form after spinning obtained.

The thus obtained aliphatic polyester multifilament crimped yarn may be used for at least a portion of a pile to manufacture a carpet whole cloth by processes such as, for example: processes for manufacturing woven carpets such as cotton carpet, Wilton carpet, face-to-face carpet, Axminster carpet and so on; processes for manufacturing embroidery carpets such as tufting carpet, hook drag carpet and so on; processes for manufacturing adhesive carpets such as bonded carpet, electrodeposited carpet, cord carpet and so on; processes for manufacturing knitted carpets such as knitted carpet, raschel carpet; and processes for tufting, and the resultant whole cloth is optionally colored as required to provide carpet having better luster, better color development and better bulkiness, and better biodegradability.

In the case of coloring the cloth, the coloring of the multifilament crimped yarn comprising aliphatic polyester fiber according to the present invention may be carried out before the above-mentioned manufacturing process of the carpet whole cloth, and in this case, the coloring can be carried out by a conventional known method of cheese dyeing or hank dyeing, and the colored yarn can be used to manufacture carpet whole cloth.

Further, in order to obtain carpets having hefty sensation with lower cost by using the above-mentioned aliphatic polyester fiber, it is preferable to use the above-mentioned aliphatic polyester fiber to manufacture the tufting carpet comprising at least face yarn of pile fiber and base cloth in which the face yarn is tufted, and in this application, in order to improve the effect of reduced load on the environment, a part of, and preferably not less than 50% of, the base cloth can be composed of the aliphatic polyester fiber.

For the base cloth of the present invention, an aliphatic polyester short fiber unwoven cloth obtainable by needle punch method, an aliphatic polyester long fiber unwoven cloth obtainable by span bonding method or flush spinning method, or a woven base cloth comprising aliphatic polyester fiber obtainable by weaving method can be typically used, and among these the aliphatic polyester long fiber unwoven cloth and the woven base cloth comprising aliphatic polyester fiber are preferably employed for the purpose of improving base cloth strength and product strength required for tufting process.

Also, the style of the tufting carpet such as level cut style, level loop style and so on may be used, and further a standard of cut and loop style can also be employed in order to improving the design ability. The suitable pile height may be selected depending on the application, and may preferably be within a range of 3 mm-30 mm, and more preferably within a range of 10 mm-20 mm.

In this case, in order to improve antistatic ability and additionally improve design ability and so on, an antistatic yarn or monofilament yarn or other yarn are allowed to be blended and weaved long as the advantageous effect obtainable by the present invention is not deteriorated.

Then, backing is prepared by the conventionally known method. In this case, a part, preferably not less than 50%, of the backing can be composed of the aliphatic polyester fiber, for the purpose of improving the effect of reducing load on the environment.

In this case, it is recommended to implement a shirring process as required as a preferable procedure. Also, in order to improve stain resistance, applying a stain-resistant agent is allowed.

EXAMPLES

The present invention is further described in more detail by referring the examples as follows. In these examples, respective properties described in the Examples were determined by the following methods:

(1) Melting Point

Measurements of the differential scanning calorimetry was carried out by using a differential scanning calorimeter (DSC-7) commercially available from Perkin Elmer at a programming temperature rising rate of 15° C./min., and the peak temperature was defined as a temperature at a peak of the obtained melting peak.

(2) Total Fineness

Total fineness was measured according to JIS L 1090.

(3) Single Yarn Fineness

Single yarn fineness was determined by dividing the total fineness with number of single yarns.

(4) Hollow Ratio

The hollow ratio is defined as a ratio of an area occupied by the hollow sections in the single yarn cross section. The single yarn is transversely cut to obtain the single yarn cross section, and thereafter the total cross section area (D) including the hollow sections and the area of the hollow sections (E) were measured by using an optical microscope, and then the hollow ratio was obtained by calculation of the following equation:

$$\text{hollow ratio (\%)}=100\times(E)/(D).$$

(5) Breaking Strength

The specimen was left for 24 hours in a heated and/or cooled enclosed room of 20° C. and 65% RH, and thereafter a tensile testing was carried out by using a tensile tester (Tensilon UCT-100) commercially available from Orientech at a condition of specimen length of 20 cm and tensile speed of 20 cm/min., and the breaking strength is defined as the stress at the breaking point.

(6) Retention of the Breaking Strength

The breaking strength (F) was presented by the method of the previous sub-section "(5) Breaking strength". Then a specimen selected from the identical package to the specimen used for the measurement of the breaking strength (F) was left for 200 days in the heated and/or cooled enclosed room of 20° C. and 65% RH, and thereafter a tensile testing was carried out by using a tensile tester (Tensilon UCT-100) commercially available from Orientech at a condition of specimen length of 20 cm and tensile speed of 20 cm/min., and the breaking strength (G) is defined as the stress at the breaking point. The retention of the breaking strength was calculated according to the following equation:

$$\text{retention of breaking strength (\%)}=100\times(G)/(F).$$

(7) Boiling Water Shrinkage

A sample yarn raveled out from a package was obtained to a form of a hank, and the length L0 of the sample yarn was measured at a condition of being subjected with a load corresponding to 0.1 g/denier (0.09 g/decitex) after being left for 24 hours within a the heated and/or cooled enclosed room of 20° C. and 65% RH, and the length L1 of the sample yarn was also measured at the condition subjected with the above described load after being immersed without any load into boiling water bath for 30 minutes and thereafter dried for more than 4 hours in the above-mentioned room, and the shrinkage was calculated according to the following equation:

$$\text{boiling water shrinkage (\%)}=[(L0-L1)/L0]\times 100.$$

(8) Coloring Agent Content (A) (weight %) is defined as a content of the coloring agent mixed to the manufactured master chip containing the coloring agent. B:C is defined as the mixing weight ratio of the base chip and the master chip during the spinning process. The coloring agent content was calculated according to the following equation:

$$\text{coloring agent content}=[(A\times C/100)/(B+C)].$$

(9) Yarn-Metal Kinetic Friction Coefficient

Figure 4:
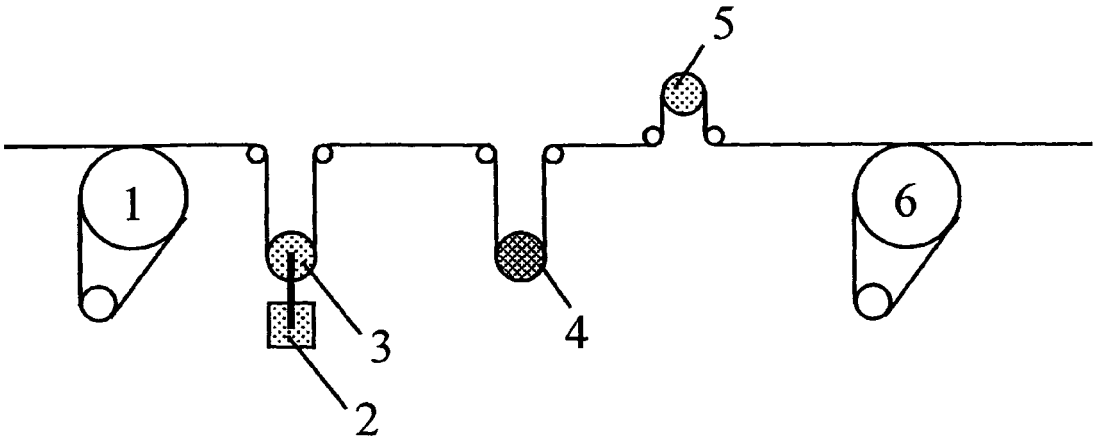
FIG. 4 is a schematic diagram of a yarn-metal friction apparatus.

The yarn-metal kinetic friction coefficient was measured by using a measuring device shown in FIG. 4. The thread was raveled out from a package by using a feed roll 1 at a feeding speed of 30 m/min., and an initial tensile strength T0 was provided by a movable pulley 3 subjected with a load 2. The passage of the thread was provided so that the thread before and after the movable pulley 3 was parallel. Next, the thread contacted with a satin-finished chrome plated-metal rod 4 having a diameter of 19 mm for a half round thereof (i.e., contacting length was 30 mm). Further, a tensile strength after the friction with the metal T1 was measured by using a loading tester 5, and thereafter the thread was discharged by a discharge roll 6. At this moment, the thread passage before and after the loading tester 5 was aligned to be parallel. Also, the speed of the discharge roll 6 was adjusted so that the movable pulley 3 maintains its fixed position.

The initial tensile strength T0 (gf) was calculated by the following equation:

$$T0(gf)=(a+b)/2$$

where a (g) is a weight of the movable pulley 3, and b (g) is the weight of the load 2.

The tensile strength T1 (gf) after subjected by the friction with metal was also calculated by the following equation:

$$T1(gf)=c/2$$

where c (g) is a weight of the load measured by the loading tester 5.

Eventually, the yarn-metal kinetic friction coefficient was calculated by the following equation:

$$\text{yarn-metal kinetic friction coefficient}=(T1-T0)/(T0+T1).$$

Here, the Example uses a measuring device comprising a movable pulley 3 having a weight (a)=100 g, and a load 2 having a weight (b)=400 g.

(10) Amount of the Adhered Oil Solution

The oil solution adhered to the yarn was removed by the solvent such as ethanol and so on. The oil amount was measured by obtaining a change of the weight between before and after removing the oil solution.

(11) Glass Transition Temperature

Measurements of the differential scanning calorimetry was carried out by using a differential scanning calorimeter (DSC-7) commercially available from Perkin Elmer at a programming temperature rising rate of 15° C./min., and the glass transition temperature thereof was defined by the thus obtained glass transition temperature.

(12) Relative Viscosity (ηr) of Polylactic Acid

Polylactic acid 0.30 g was dissolved into 10 ml of ortho chlorophenol, and viscosity was measured by using Ostwald viscosity meter at 25° C. ηr was calculated by the following equation:

$$\eta r=t/t0$$

where t: falling time (sec.) of the solution of ortho chlorophenol containing a sample dissolved therein; and T0: falling time (sec.) of the solvent ortho chlorophenol itself.

(13) Relative Viscosity (ηr) of Polyethylene Terephthalate (PET)

PET sample 0.10 g was dissolved into 10 ml of ortho chlorophenol, and viscosity was measured by using Ostwald viscosity meter at 25° C. ηr was calculated by the following equation:

$$\eta r=t/t0$$

where t: falling time (sec.) of the solution of ortho chlorophenol containing a sample dissolved therein; and T0: falling time (sec.) of the solvent ortho chlorophenol itself.

(14) Relative Viscosity (ηr) of Nylon

Nylon sample was dissolved into 98% sulfuric acid so that the nylon content is 1% wt., and viscosity was: measured by using Ostwald viscosity meter at 25° C. ηr was calculated by the following equation:

$$\eta r=t/t0$$

where t: falling time (sec.) of the solution of 98% sulfuric acid containing a sample dissolved therein; and T0: falling time (sec.) of the solvent 98% sulfuric acid itself.

(15) Spinning Ability

Thread breaking occurred during the drawing process and crimping process was evaluated, and the results were classified to four categories: ⊙ . . . very good; ○ . . . good; Δ . . . slightly poor; and x . . . poor. ⊙, ○ and Δ were acceptable results.

(16) Tufting Ability

Stopping of the manufacturing machine due to a defect of the pile raw yarn such as stopping by thread breakage during the tufting was evaluated, and the results were classified to four categories: ⊙ . . . very good; ○ . . . good; Δ . . . slightly poor; and x . . . poor. The categories of ⊙, ○ and Δ were the acceptable results.

(17) Luster

Luster of the developed color of the cloth colored according to the following condition was visually evaluated, and the results were classified to four categories: ⊙ . . . very good; ○ . . . good; Δ . . . slightly poor; and x . . . poor. The categories of ⊙, ○ and Δ were the acceptable results. Dispersion dye Sumikaron Navy Blue S-2GL: 0.6% owf, Tetrosin Pen: 5.0% owf, coloring temperature: 98° C.×60 minutes, and bath ratio: 1:50.

(18) Texture

Texture of a carpet when a tester put his/her hand onto the carpet was sensually evaluated, and the results were classified to four categories: ⊙ . . . softest and provide most resilient sensation; ○ . . . provide good texture; Δ . . . provide slightly poor texture; and x . . . provide poor texture. The categories of ⊙, ○ and Δ were the acceptable results.

(19) Bulkiness

A carpet was placed under the sunlight, and transparency of the cloth was visually evaluated, and the results were classified to four categories: ⊙ . . . provide best bulkiness and no transparency; ○ . . . provide good bulkiness; Δ . . . provide slightly poor bulkiness; and x . . . provide poor bulkiness and considerable transparency. The categories of ⊙, ○ and Δ were the acceptable results.

(20) Compression Resistance

According to JIS L 1021 7, pile of a carpet that had been subject to 500 compressions was visually evaluated, and the results were classified to four categories: ⊙ . . . no damage on the pile and thus provide best compression resistance; ○ . . . provide good compression resistance; Δ . . . provide slightly poor compression resistance; and x . . . considerable damage on the pile and thus provide poor compression resistance. The categories of ⊙, ○ and Δ were the acceptable results.

(21) Biodegradability

The obtained carpet was cut to a dimension of 30 cm×30 cm to provide a sample, and the sample was taken within soil of a condition of 30° C., and humidity 80%, then picked up the sample from the soil after 6 months and the morphology of the carpet sample was visually evaluated to determine the biodegradability, and the results were classified to four categories: ⊙ . . . none of the original morphology of the carpet was retained (thus provide best biodegradability); ○ . . . original morphology of the carpet was slightly retained (thus provide good biodegradability); Δ . . . changes from the original morphology of the carpet was unremarkable (thus provide slightly poor biodegradability); and x . . . the original morphology of the carpet was substantially retained (thus provide poor biodegradability). The categories of ⊙ and ○ were the acceptable results.

Example 1

Chip of poly lactic acid (PLA) having melting point of 172° C., glass transition temperature of 57° C., refractive index of 1.45, weight average molecular weight of 204,000, relative viscosity of 21.0, L-isomer ratio of 98% and D-isomer ratio of 2% was dried for 6 hours within a vacuum atmosphere of 80° C. The dried polylactic acid chip had a moisture percentage of 150 ppm.

The dried polylactic acid chip was then melted in the extruder spinning machine at a temperature of 220° C., and extruded through a spinning die having 96 discharging apertures for triphyllous cross sectional shape and thus spun. At this moment, the spin pack containing a barrier filter and the spinning die was heated at a temperature of 220° C. In addition, the discharging apertures for the triphyllous cross sectional shape were designed to a shape of the discharging aperture (slit length and slit ratio and so on) for obtaining desired heteromorphic level.

The spun thread was cooled by a cooling air from a uniflow chimney having a wind velocity of 40 m/min. and wind temperature of 18° C., and thereafter the thread was aligned and applied with an oil solution by an oiling roller. The oil solution used herein contained 25% of an oil solution dissolved into a low viscous mineral oil to form the oil solution, and the oil solution included the following smoother agent component, extreme-pressure agent component and surfactant component. The oil solution included the smoother agent component of polyester type agent, and was non-aqueous oil solution.

Smoother agent component: ester (molecular weight of 6,000) of ethylene oxide-propylene oxide copolymer (molecular weight of 2,750) and adipic acid and lauric acid; Extreme-pressure agent component: lauryl (ethylene oxide) diphosphate potassium salt, oleic acid soap; and Surfactant component: octyl alcohol additionally including propylene oxide and ethylene oxide (molecular weight of 1,500).

The thread applied with the oil solution was then taken off to first take-off roll having a surface speed of 792 m/min., and then the thread acquired 1% pre-stretch between the first take-off roll and second take-off roll having a surface speed of 800 m/min. Here the second take-off roll was heated to a temperature of 75° C. in order to pre-heat for drawing process. It should be noted that the pre-stretch of within 3% is carried out for aligning the thread that was taken-off, and thus not correspond to the drawing.

The thread preheated by the second take-off roll was subjected to first drawing process between the second take-off roll and first drawing roll having a surface speed of 1,600 m/min. and a temperature of 80° C., and subjected to second drawing process between the first drawing roll and second drawing roll having a surface speed of 2,000 m/min. and a temperature of 105° C. That is, the yarn was drawn to 2.0 times at the first step, and 1.25 times at the second stage, and thus 2.5 times in total.

The thread after being drawn at the second stage was then crimped by using the heated fluid crimping machine as described in the Japanese Unexamined Patent Application Publication No. 08-269834, and then cooled by a known rotary filter. The heated fluid used herein was heated air having a pressured of 0.78 MPa (8.0 kgf/cm$^2$) and a temperature of 150° C.

The crimped and cooled thread was then subject to a tensile force between a first stretch roll and a second stretch roll, speed of which were adjusted so as to provide a tensile strength of 130 gf, for the purpose of taking up a slack caused by the crimping without having an interrupting winding-up process, and entangled by a known entangling apparatus, and then wound up to a winder at a winding tensile strength of 130 gf.

Thus, obtained was a polylactic acid crimped yarn having: a total fineness of 2,000 decitex; number of single yarns of 96; a single yarn fineness of 21 decitex; a crimp elongation rate after being processed with boiling water of 7.0%; a boiling water shrinkage of 6.5%; a breaking strength of 1.9 cN/decitex; a retention of the breaking strength of 95%; an amount of the adhered oil solution of 0.60%; a yarn-metal kinetic friction coefficient of 0.35; triphyllous ("Y"-shaped) cross sectional shape, a heteromorphic level of 3.2; and number of entangling of 10/m.

The resultant polylactic acid crimped yarn was cheese-dyed and thereafter tufted to a base cloth consisting of aliphatic polyester span bond unwoven cloth, and eventually a level loop cut pile carpet was obtained. The obtained carpet was evaluated on the tufting ability, the luster, the texture, the bulkiness, the compression resistance and the biodegradability. The results of the evaluation of the carpet and the yarn quality of the aforementioned crimped yarn and so on were shown in Table 1.

TABLE 1

| | | Ex. 1 | Ex. 2 | Ex. 3 | Ex. 4 | Ex. 5 | Ex. 6 |
|---|---|---|---|---|---|---|---|
| polymer | — | PLA | PLA | PLA | PLA | PLA | PLA |
| melting point | ° C. | 172 | 172 | 172 | 172 | 172 | 172 |
| refractive index | — | 1.45 | 1.45 | 1.45 | 1.45 | 1.45 | 1.45 |
| cross sectional shape | — | Y(tri-phyllous) | circular | hexa-phyllos | Y hollow (tri-phyllous) | quartered hollow | Y(tri-phyllous) |
| heteromorphic level (D/d) | — | 3.2 | 1.0 | 1.4 | 2.8 | 1.1 | 3.2 |
| (h/L) × 100 | | — | — | 16.2 | — | — | — |
| Hollow ratio | % | — | — | — | 10 | 10 | — |
| Thickness | μm | — | — | — | 5 | 5 | — |
| total fineness | dtex | 2000 | 2000 | 2000 | 2000 | 2000 | 2000 |
| single yarn fineness | dtex | 21 | 21 | 21 | 21 | 21 | 21 |
| crimp elongation rate after processed with boiling water | % | 7.0 | 5.2 | 6.4 | 7.6 | 9.6 | 6.8 |
| breaking strength | cN/dtex | 1.9 | 2.8 | 2.2 | 1.5 | 1.7 | 1.9 |
| retention of breaking strength | % | 95 | 96 | 95 | 93 | 94 | 95 |
| boiling water shrinkage | % | 6.5 | 7.8 | 7.0 | 6.7 | 8.0 | 12.8 |
| coloring agent | — | — | — | — | — | — | — |
| coloring agent content | % | — | — | — | — | — | — |
| yarn-metal kinetic friction coeff. | — | 0.35 | 0.34 | 0.37 | 0.35 | 0.34 | 0.36 |
| condition of dissolving oil solution | — | nonaqueous | nonaqueous | nonaqueous | nonaqueous | nonaqueous | nonaqueous |
| amount of adhered oil sol. | % | 0.60 | 0.60 | 0.70 | 0.60 | 0.60 | 0.60 |
| drawing rate: first step/second step/total | — | 2.0/1.25/2.5 | 2.0/1.25/2.5 | 2.0/1.25/2.5 | 2.0/1.25/2.5 | 2.0/1.25/2.5 | 2.0/1.25/2.5 |
| crimping manner | — | continuous | continuous | continuous | continuous | continuous | continuous |
| heated fluid for crimping | — | heated air | heated air | heated air | heated air | heated air | heated air |
| glass transition temp. | ° C. | 57 | 57 | 57 | 57 | 57 | 57 |
| pre-heat temperature before drawing | ° C. | 75 | 75 | 75 | 75 | 75 | 75 |
| spinning ability | — | ⊙ | ⊙ | ⊙ | ⊙ | ⊙ | ⊙ |
| Tufting ability | — | ⊙ | ⊙ | ⊙ | ⊙ | ⊙ | ○ |
| Luster | — | ⊙ | ⊙ | ⊙ | ⊙ | ⊙ | ⊙ |
| Texture | — | ○ | ○ | ○ | ○ | ○ | Δ |
| Bulkiness | — | ○ | Δ | ○ | ⊙ | ○ | ○ |
| compression resistance | — | ○ | ○ | ○ | ○ | ○ | ○ |
| Biodegradability | — | ⊙ | ○ | ⊙ | ⊙ | ⊙ | ⊙ |

| | | Ex. 7 | Ex. 8 | Ex. 9 | Ex. 10 | Ex. 11 | Comparative Ex. 1 |
|---|---|---|---|---|---|---|---|
| polymer | — | PLA | PLA | PLA | PLA | PLA | PLA |
| melting point | ° C. | 172 | 172 | 172 | 172 | 172 | 172 |
| refractive index | — | 1.45 | 1.45 | 1.45 | 1.45 | 1.45 | 1.45 |
| cross sectional shape | — | Y(tri-phyllous) | Y(tri-phyllous) | Y(tri-phyllous) | Y(tri-phyllous) | Y(tri-phyllous) | Y(tri-phyllous |
| heteromorphic level (D/d) | — | 3.3 | 3.5 | 3.2 | 3.2 | 3.2 | 3.2 |
| (h/L) × 100 | | — | — | — | — | — | — |
| Hollow ratio | % | — | — | — | — | — | — |
| thickness | μm | — | — | — | — | — | — |
| total fineness | dtex | 2000 | 2000 | 2000 | 2000 | 2000 | 2000 |
| single yarn fineness | dtex | 21 | 21 | 21 | 21 | 21 | 21 |
| crimp elongation rate after processed with boiling water | % | 7.4 | 8.8 | 9.7 | 7.0 | 9.5 | 1.8 |
| breaking strength | cN/dtex | 1.7 | 1.2 | 1.1 | 1.4 | 1.5 | 2.1 |
| retention of breaking strength | % | 93 | 91 | 86 | 65 | 95 | 96 |
| boiling water shrinkage | % | 7.6 | 9.5 | 9.2 | 8.6 | 5.6 | 9.3 |
| coloring agent | — | included | included | — | — | — | — |
| coloring agent content | % | 0.08 | 1.5 | — | — | — | — |
| yarn-metal kinetic friction coeff. | — | 0.37 | 0.38 | 0.45 | 0.38 | 0.36 | 0.36 |

TABLE 1-continued

| | | | | | | | |
|---|---|---|---|---|---|---|---|
| condition of dissolving oil solution | — | nonaqueous | nonaqueous | nonaqueous | aqueous | nonaqueous | nonaqueous |
| amount of adhered oil sol. | % | 0.60 | 0.60 | 0.08 | 0.66 | 0.56 | 0.80 |
| drawing rate: first step/second step/total | — | 2.0/1.25/2.5 | 2.0/1.25/2.5 | 2.0/1.25/2.5 | 2.0/1.25/2.5 | 2.0/1.25/2.5 | 2.0/1.25/2.5 |
| crimping manner | — | continuous | continuous | continuous | continuous | discontinous | continuous |
| heated fluid for crimping | — | heated air | heated air | heated air | heated air | heated air | heated air |
| glass transition temp. | ° C. | 57 | 57 | 57 | 57 | 57 | 57 |
| pre-heat temperature before drawing | ° C. | 75 | 75 | 75 | 75 | 75 | 75 |
| spinning ability | — | ⊙ | ○ | Δ | ⊙ | ⊙ | ○ |
| Tufting ability | — | ⊙ | ○ | Δ | ⊙ | ⊙ | ○ |
| luster | — | ⊙ | ⊙ | ○ | ⊙ | ⊙ | ⊙ |
| texture | — | ○ | ○ | Δ | ○ | ○ | x |
| bulkiness | — | ○ | ○ | ○ | ○ | ○ | x |
| compression resistance | — | ○ | Δ | Δ | Δ | ○ | ○ |
| biodegradability | — | ○ | ○ | ⊙ | ⊙ | Ex. 13 | Comparative Ex. 1 |

| | | Comparative Ex. 2 | Comparative Ex. 3 | Comparative Ex. 4 | Comparative Ex. 5 | Comparative Ex. 6 |
|---|---|---|---|---|---|---|
| polymer | — | PLA | PET | nylon | PLA | PLA |
| melting point | ° C. | 172 | 260 | 220 | 172 | 172 |
| refractive index | — | 1.45 | 1.56 | 1.53 | 1.45 | 1.45 |
| cross sectional shape | — | Y(tri-phyllous) | Y(tri-phyllous) | Y(Tri-phyllous) | Y(tri-phyllous) | Y(tri-phyllous) |
| heteromorphic level (D/d) | — | 3.2 | 2.0 | 3.3 | 3.2 | 3.2 |
| (h/L) × 100 | | — | — | — | — | — |
| Hollow ratio | % | — | — | — | — | — |
| thickness | μm | — | — | — | — | — |
| total fineness | dtex | 2000 | 2000 | 2000 | 2000 | 2000 |
| single yarn fineness | dtex | 21 | 21 | 21 | 21 | 21 |
| crimp elongation rate after processed with boiling water | % | 15.0 | 5.0 | 19.0 | 10.2 | 8.2 |
| breaking strength | cN/dtex | 0.7 | 4.0 | 2.8 | 1.2 | 1.2 |
| retention of breaking strength | % | 90 | 95 | 98 | 84 | 94 |
| boiling water shrinkage | % | 4.4 | 5.0 | 5.2 | 6.3 | 8.6 |
| coloring agent | — | — | — | — | — | — |
| coloring agent content | % | — | — | — | — | — |
| yarn-metal kinetic friction coeff. | — | 0.38 | 0.39 | 0.36 | 0.36 | 0.37 |
| condition of dissolving oil solution | — | nonaqueous | Aqueous | aqueous | nonaqueous | nonaqueous |
| amount of adhered oil sol. | % | 0.70 | 0.80 | 0.60 | 0.70 | 0.60 |
| drawing rate: first step/second step/total | — | 2.0/1.25/2.5 | 3.0/—/3.0 | 2.8/1.25/3.5 | 2.0/1.25/2.5 | 2.5/—/2.5 |
| crimping manner | — | continuous | Continuous | continuous | continuous | continuous |
| heated fluid for crimping | — | heated air | heated air | heated air | Super-heated steam | heated air |
| glass transition temp. | ° C. | 57 | 70 | 45 | 57 | 57 |
| pre-heat temperature before drawing | ° C. | 75 | 100 | 50 | 75 | 75 |
| spinning ability | — | ○ | ⊙ | ⊙ | ○ | Δ |
| Tufting ability | — | x | ○ | ⊙ | ⊙ | ○ |
| luster | — | ⊙ | Δ | x | ⊙ | Δ |
| texture | — | ○ | Δ | ⊙ | ○ | ○ |
| bulkiness | — | ⊙ | ○ | ⊙ | ○ | ○ |
| compression resistance | — | x | ○ | ⊙ | ○ | Δ |
| biodegradability | — | Comparative Ex. 2 | Comparative Ex. 3 | Comparative Ex. 4 | ⊙ | ⊙ |

Example 2

A similar method to Example 1 except that the spinning die was changed to a spinning die having 96 discharging apertures for circular cross sectional shape was carried out to obtain a polylactic acid crimped yarn having: a total fineness of 2,000 decitex; number of single yarns of 96; a single yarn fineness of 21 decitex; a crimp elongation rate after being processed with boiling water of 5.2%; a boiling water shrinkage of 7.8%; a breaking strength of 2.8 cN/decitex; a retention of the breaking strength of 96%; an amount of the adhered oil solution of 0.60%; a yarn-metal kinetic friction coefficient of 0.34; circular cross sectional shape, a heteromorphic level of 1.0; and number of entangling of 10/m.

Then a carpet was obtained by a similar method to Example 1, and the obtained carpet was evaluated on the tufting ability, the luster, the texture, the bulkiness, the compression resistance and the biodegradability. The results of the evaluation of the carpet and the yarn quality of the aforementioned crimped yarn and so on were shown in Table 1.

Example 3

A similar method to Example 1 except that the spinning die was changed to a spinning die having 96 discharging apertures for hexaphyllous cross sectional shape was carried out to obtain a polylactic acid crimped yarn having: a total fineness of 2,000 decitex; number of single yarns of 96; a single yarn fineness of 21 decitex; a crimp elongation rate after being processed with boiling water of 6.4%; a boiling water shrinkage of 7.0%; a breaking strength of 2.2 cN/decitex; a retention of the breaking strength of 95%; an amount of the adhered oil solution of 0.70%; a yarn-metal kinetic friction coefficient of 0.37; hexaphyllous cross sectional shape, a heteromorphic level of 1.4; a value of [(h/L)×100] of 16.2; and number of entangling of 10/m.

Then a carpet was obtained by a similar method to Example 1, and the obtained carpet was evaluated on the tufting ability, the luster, the texture, the bulkiness, the compression resistance and the biodegradability. The results of the evaluation of the carpet and the yarn quality of the aforementioned crimped yarn and so on were shown in Table 1.

Example 4

A similar method to Example 1 except that the spinning die was changed to a spinning die having 96 discharging apertures for "Y"-shaped hollow (triphyllous and hollow) cross sectional shape was carried out to obtain a polylactic acid crimped yarn having: a total fineness of 2,000 decitex; number of single yarns of 96; a single yarn fineness of 21 decitex; a crimp elongation rate after being processed with boiling water of 7.6%; a boiling water shrinkage of 6.7%; a breaking strength of 1.5 cN/decitex; a retention of the breaking strength of 93%; an amount of the adhered oil solution of 0.60%; a yarn-metal kinetic friction coefficient of 0.35; "Y"-shaped hollow (triphyllous and hollow) cross sectional shape, a heteromorphic level of 2.8; hollow rate of 10%; a thick ness between the outer circumference and the hollow section of the cross section of 5 μm; and number of entangling of 10/m.

Then a carpet was obtained by a similar method to Example 1, and the obtained carpet was evaluated on the tufting ability, the luster, the texture, the bulkiness, the compression resistance and the biodegradability. The results of the evaluation of the carpet and the yarn quality of the aforementioned crimped yarn and so on were shown in Table 1.

Example 5

A similar method to Example 1 except that the spinning die was changed to a spinning die having 96 discharging apertures for quartered hollow cross sectional shape was carried out to obtain a polylactic acid crimped yarn having: a total fineness of 2,000 decitex; number of single yarns of 96; a single yarn fineness of 21 decitex; a crimp elongation rate after being processed with boiling water of 9.6%; a boiling water shrinkage of 8.0%; a breaking strength of 1.7 cN/decitex; a retention of the breaking strength of 94%; an amount of the adhered oil solution of 0.60%; a yarn-metal kinetic friction coefficient of 0.34; quartered hollow cross sectional shape, a heteromorphic level of 1.1; hollow rate of 10%; a thick ness between the outer circumference and the hollow section of the cross section of 5 μm; and number of entangling of 10/m.

Then a carpet was obtained by a similar method to Example 1, and the obtained carpet was evaluated on the tufting ability, the luster, the texture, the bulkiness, the compression resistance and the biodegradability. The results of the evaluation of the carpet and the yarn quality of the aforementioned crimped yarn and so on were shown in Table 1.

Example 6

A similar method to Example 1 except that the temperature of heated air was changed to 170° C., and that the tensile stress between the first stretch roll and the second stretch roll was changed to 180 gf, was carried out to obtain a polylactic acid crimped yarn having: a total fineness of 2,000 decitex; number of single yarns of 96; a single yarn fineness of 21 decitex; a crimp elongation rate after being processed with boiling water of 6.8%; a boiling water shrinkage of 12.8%; a breaking strength of 1.9 cN/decitex; a retention of the breaking strength of 95%; an amount of the adhered oil solution of 0.60%; a yarn-metal kinetic friction coefficient of 0.36; triphyllous ("Y"-shaped) cross sectional shape, a heteromorphic level of 3.2; and number of entangling of 10/m.

Then a carpet was obtained by a similar method to Example 1, and the obtained carpet was evaluated on the tufting ability, the luster, the texture, the bulkiness, the compression resistance and the biodegradability. The results of the evaluation of the carpet and the yarn quality of the aforementioned crimped yarn and so on were shown in Table 1.

Example 7

A coloring agent was added to chip of poly lactic acid (L-isomer ratio: 98%; D-isomer ratio: 2%) having melting point of 172° C., glass transition temperature of 57° C., refractive index of 1.45, weight average molecular weight of 204,000 and relative viscosity of 21.0 to produce a solution-dyed master chip. The solution-dyed master chip included a coloring agent comprising kneaded composite of: 0.6% wt. of colcothar for red color; 0.6% wt. of carbon black for black color; and 0.4% wt. of titanium yellow for yellow color.

Then, a chip of poly lactic acid (L-isomer ratio: 98%; D-isomer ratio: 2%) having melting point of 172° C., glass transition temperature of 57° C., refractive index of 1.45, weight average molecular weight of 204,000 and relative viscosity of 21.0 was chip-blended with the aforementioned solution-dyed master chip at a blending ratio of 20:1. The content of the coloring agent in the blended chip was 0.08% wt.

A similar method to Example 1 except that the thus obtained blended chip was employed was carried out to obtain a solution-dyed polylactic acid crimped yarn dyed with a light beige color having: a total fineness of 2,000 decitex; number of single yarns of 96; a single yarn fineness of 21 decitex; a crimp elongation rate after being processed with boiling water of 7.4%; a boiling water shrinkage of 7.6%; a breaking strength of 1.7 cN/decitex; a retention of the breaking strength of 93%; an amount of the adhered oil solution of 0.60%; a yarn-metal kinetic friction coefficient of 0.37; triphyllous ("Y"-shaped) cross sectional shape, a heteromorphic level of 3.3; and number of entangling of 10/m.

The resultant polylactic acid crimped yarn was steam-processed and thereafter tufted to a base cloth consisting of aliphatic polyester span bond unwoven cloth, and eventually a level loop cut pile carpet was obtained. The obtained carpet was evaluated on the tufting ability, the luster, the texture, the bulkiness, the compression resistance and the biodegradability. The results of the evaluation of the carpet and the yarn quality of the aforementioned crimped yarn and so on were shown in Table 1.

Example 8

A coloring agent was added to chip of poly lactic acid (L-isomer ratio: 98%; D-isomer ratio: 2%) having melting point of 172° C., glass transition temperature of 57° C., refractive index of 1.45, weight average molecular weight of 204,000 and relative viscosity of 21.0 to produce a solution-dyed master chip. The solution-dyed master chip included a coloring agent comprising kneaded composite of: 8.2% wt. of colcothar for red color; 2.0% wt. of carbon black for black color; 3.0% wt. of titanium oxide for white color; and 1.8% wt. of cyanine organic pigment for blue color.

Then, a chip of poly lactic acid (L-isomer ratio: 0.98%; D-isomer ratio: 2%) having melting point of 172° C., glass transition temperature of 57° C., refractive index of 1.45, weight average molecular weight of 204,000 and relative viscosity of 21.0 was chip-blended with the aforementioned solution-dyed master chip at a blending ratio of 9:1. The content of the coloring agent in the blended chip was 1.5% wt.

A similar method to Example 1 except that the thus obtained blended chip was employed was carried out to obtain a solution-dyed polylactic acid crimped yarn dyed with a dark gray color having: a total fineness of 2,000 decitex; number of single yarns of 96; a single yarn fineness of 21 decitex; a crimp elongation rate after being processed with boiling water of 8.8%; a boiling water shrinkage of 9.5%; a breaking strength of 1.2 cN/decitex; a retention of the breaking strength of 91%; an amount of the adhered oil solution of 0.60%; a yarn-metal kinetic friction coefficient of 0.38; triphyllous ("Y"-shaped) cross sectional shape, a heteromorphic level of 3.5; and number of entangling of 10/m.

Then a carpet was obtained by a similar method to Example 7, and the obtained carpet was evaluated on the tufting ability, the luster, the texture, the bulkiness, the compression resistance and the biodegradability. The results of the evaluation of the carpet and the yarn quality of the aforementioned crimped yarn and so on were shown in Table 1.

Example 9

A similar method to Example 1 except that the revolution speed of the oiling roller was decreased was carried out to obtain a polylactic acid crimped yarn having: a total fineness of 2,000 decitex; number of single yarns of 96; a single yarn fineness of 21 decitex; a crimp elongation rate after being processed with boiling water of 9.7%; a boiling water shrinkage of 9.2%; a breaking strength of 1.1 cN/decitex; a retention of the breaking strength of 86%; an amount of the adhered oil solution of 0.08%; a yarn-metal kinetic friction coefficient of 0.45; triphyllous ("Y"-shaped) cross sectional shape, a heteromorphic level of 3.2; and number of entangling of 10/m.

Then a carpet was obtained by a similar method to Example 1, and the obtained carpet was evaluated on the tufting ability, the luster, the texture, the bulkiness, the compression resistance and the biodegradability. The results of the evaluation of the carpet and the yarn quality of the aforementioned crimped yarn and so on and so on were shown in Table 1.

Example 10

A similar method to Example 1 except that an oil solution was composed of the smoother agent component, the extreme-pressure agent component and the surfactant component described in Example 1, which were diluted with pure water to 25% wt., was carried out. That is, the smoother agent component was polyester type agent, and the oil solution was an aqueous oil solution. A polylactic acid crimped yarn having: a total fineness of 2,000 decitex; number of single yarns of 96; a single yarn fineness of 21 decitex; a crimp elongation rate after being processed with boiling water of 7.0%; a boiling water shrinkage of 8.6%; a breaking strength of 1.4 cN/decitex; a retention of the breaking strength of 65%; an amount of adhered the oil solution of 0.66%; a yarn-metal kinetic friction coefficient of 0.38; triphyllous ("Y"-shaped) cross sectional shape, a heteromorphic level of 3.2; and number of entangling of 10/m, was obtained.

Then a carpet was obtained by a similar method to Example 1, and the obtained carpet was evaluated on the tufting ability, the luster, the texture, the bulkiness, the compression resistance and the biodegradability. The results of the evaluation of the carpet and the yarn quality of the aforementioned crimped yarn and so on and so on were shown in Table 1.

Example 11

A similar method to Example 1 was carried out except that the thread, which had been drawn by two step-drawing, was lightly entangled by a known entangling apparatus, without being processed via the heated fluid crimping, and then wound up to a winder at a winding tensile strength of 120 gf. That is, the thread was once would up to the package in a linear and straight form.

Then, the thread would to the package was crimped via the heated fluid crimping process in the subsequent process.

The thread raveled out from a package was then taken off to the first take-off roll having a surface speed of 922 m/min., and then the thread acquired 3% pre-stretch between the first take-off roll and second take-off roll having a surface speed of 950 m/min. Here the second take-off roll was heated to a temperature of 110° C. in order to pre-heat for drawing process. It should be noted that the pre-stretch of within 3% is carried out for aligning the thread that was taken-off, and thus not correspond to the drawing.

The thread after being drawn at the second stage was then crimped by using the heated fluid crimping machine as described in the Japanese Unexamined Patent Application Publication No. 08-269834, and then cooled by a known rotary filter. The heated fluid used herein was heated air having a pressured of 0.78 MPa (8.0 kgf/cm$^2$) and a temperature of 150° C.

The crimped and cooled thread was then subject to a tensile force between a first stretch roll and a second stretch roll, speed of which were adjusted so as to provide a tensile strength of 130 gf, for the purpose of taking up a slack caused by the crimping without having an interrupting winding-up process, and entangled by a known entangling apparatus, and then wound up to a winder at a winding tensile strength of 130 gf.

Thus, obtained via two-step method was a polylactic acid crimped yarn having: a total fineness of 2,000 decitex; number of single yarns of 96; a single yarn fineness of 21 decitex; a crimp elongation rate after being processed with boiling water of 9.5%; a boiling water shrinkage of 5.6%; a breaking strength of 1.5 cN/decitex; a retention of the breaking strength of 95%; an amount of the adhered oil solution of 0.56%; a yarn-metal kinetic friction coefficient of 0.36; triphyllous ("Y"-shaped) cross sectional shape, a heteromorphic level of 3.2; and number of entangling of 10/m.

Then a carpet was obtained by a similar method to Example 1, and the obtained carpet was evaluated on the tufting ability, the luster, the texture, the bulkiness, the compression resistance and the biodegradability. The results of the evaluation of the carpet and the yarn quality of the aforementioned crimped yarn and so on were shown in Table 1.

Comparative Example 1

A similar method to Example 1 except that the temperature of the second drawing roll was 85° C. and the temperature of the heated air was 90° C., was carried out to obtain a polylactic acid crimped yarn having: a total fineness of 2,000 decitex; number of single yarns of 96; a single yarn fineness of 21 decitex; a crimp elongation rate after being processed with boiling water of 1.8%; a boiling water shrinkage of 9.3%; a breaking strength of 2.1 cN/decitex; a retention of the breaking strength of 96%; an amount of the adhered oil solution of 0.80%; a yarn-metal kinetic friction coefficient of 0.36; triphyllous ("Y"-shaped) cross sectional shape, a heteromorphic level of 3.2; and number of entangling of 10/m.

Then a carpet was obtained by a similar method to Example 1, and the obtained carpet was evaluated on the tufting ability, the luster, the texture, the bulkiness, the compression resistance and the biodegradability. The results of the evaluation of the carpet and the yarn quality of the aforementioned crimped yarn and so on and so on were shown in Table 1.

Comparative Example 2

A similar method to Example 1 except that the temperature of the second drawing roll was 115° C. and the temperature of the heated air was 190° C., was carried out to obtain a polylactic acid crimped yarn having: a total fineness of 2,000 decitex; number of single yarns of 96; a single yarn fineness of 21 decitex; a crimp elongation rate after being processed with boiling water of 15.0%; a boiling water shrinkage of 4.4%; a breaking strength of 0.7 cN/decitex; a retention of the breaking strength of 90%; an amount of the adhered oil solution of 0.70%; a yarn-metal kinetic friction coefficient of 0.38; triphyllous ("Y"-shaped) cross sectional shape, a heteromorphic level of 3.2; and number of entangling of 10/m.

Then a carpet was obtained by a similar method to Example 1, and the obtained carpet was evaluated on the tufting ability, the luster, the texture, the bulkiness, the compression resistance and the biodegradability. The results of the evaluation of the carpet and the yarn quality of the aforementioned crimped yarn and so on and so on were shown in Table 1.

Comparative Example 3

Chip of polyethylene terephthalate (PET) having melting point of 260° C., glass transition temperature of 70° C., refractive index of 1.56 and relative viscosity of 26.3 was melted in the extruder spinning machine at a temperature of 300° C., and extruded through a spinning die having 96 discharging apertures for triphyllous cross sectional shape and thus spun. At this moment, the spin pack containing a barrier filter and the spinning die was heated at a temperature of 300° C. In addition, the discharging apertures for the triphyllous cross sectional shape were designed to a shape of the discharging aperture (slit length and slit ratio and so on) for obtaining desired heteromorphic level.

The spun thread was cooled by a cooling air from a uniflow chimney having a wind velocity of 30 m/min. and wind temperature of 18° C., and thereafter the thread was aligned and applied with an oil solution by an oiling roller. The oil solution used herein contained 25% of an oil solution dissolved into pure water to form the oil solution, and the oil solution included the following smoother agent component, extreme-pressure agent component and surfactant component. The oil solution included the smoother agent component of polyester type agent, and was aqueous oil solution.

Smoother agent component: ester (molecular weight of 6,000) of ethylene oxide-propylene oxide copolymer (molecular weight of 2,750) and adipic acid and lauric acid; Extreme-pressure agent component: lauryl (ethylene oxide) diphosphate potassium salt, oleic acid soap; and Surfactant component: octyl alcohol additionally including propylene oxide and ethylene oxide (molecular weight of 1,500).

The thread applied with the oil solution was then taken off to first take-off roll having a surface speed of 971 m/min., and then the thread acquired 3% pre-stretch between the first take-off roll and second take-off roll having a surface speed of 1,000 m/min. Here the second take-off roll was heated to a temperature of 100° C. in order to pre-heat for drawing process. It should be noted that the pre-stretch of within 3% is carried out for aligning the thread that was taken-off, and thus not correspond to the drawing.

The thread preheated by the second take-off roll was subjected to first drawing process between the second take-off roll and first drawing roll having a surface speed of 3,000 m/min. and a temperature of 230° C. That is, the drawing was carrying out as a single step process in which the yarn was drawn to 3.0 times at the first step.

The thread after being drawn at the first stage was then crimped by using the heated fluid crimping machine as described in the Japanese Unexamined Patent Application Publication No. 08-269834, and then cooled by a known rotary filter. The heated fluid used herein was heated air having a pressured of 0.78 MPa (8.0 kgf/cm$^2$) and a temperature of 250° C.

The crimped and cooled thread was then subject to a tensile force between a first stretch roll and a second stretch roll, speed of which were adjusted so as to provide a tensile strength of 130 gf, for the purpose of taking up a slack caused by the crimping without having an interrupting winding-up process, and entangled by a known entangling apparatus, and then wound up to a winder at a winding tensile strength of 130 gf.

Thus, obtained was a PET crimped yarn having: a total fineness of 2,000 decitex; number of single yarns of 96; a single yarn fineness of 21 decitex; a crimp elongation rate after being processed with boiling water of 5.0%; a boiling water shrinkage of 5.0%; a breaking strength of 4.0 cN/decitex; a retention of the breaking strength of 95%; an amount of adhered the oil solution of 0.80%; a yarn-metal kinetic friction coefficient of 0.39; triphyllous ("Y"-shaped) cross sectional shape, a heteromorphic level of 2.0; and number of entangling of 0.10/m.

The resultant PET crimped yarn was cheese-dyed and thereafter tufted to a base cloth consisting of aliphatic polyester span bond unwoven cloth, and eventually a level loop cut pile carpet was obtained. The obtained carpet was evaluated on the tufting ability, the luster, the texture, the bulkiness, the compression resistance and the biodegradability. The results of the evaluation of the carpet and the yarn quality of the aforementioned crimped yarn and so on were shown in Table 1.

Comparative Example 4

Chip of nylon 6 having melting point of 220° C., glass transition temperature of 45° C., refractive index of 1.53 and relative viscosity of 2.8 was melted in the extruder spinning machine at a temperature of 260° C., and extruded through a spinning die having 96 discharging apertures for triphyllous cross sectional shape and thus spun. At this moment, the spin pack containing a barrier filter and the spinning die was heated at a temperature of 260° C. In addition, the discharging apertures for the triphyllous cross sectional shape were designed to a shape of the discharging aperture (slit length and slit ratio and so on) for obtaining desired heteromorphic level.

The spun thread was cooled by a cooling air from a uniflow chimney having a wind velocity of 40 m/min. and wind temperature of 18° C., and thereafter the thread was aligned and applied with an oil solution by an oiling roller. The oil solution used herein contained 25% of an oil solution dissolved into pure water to form the oil solution, and the oil solution included the following smoother agent component, extreme-pressure agent component and surfactant component. The oil solution included the smoother agent component of polyester type agent, and was aqueous oil solution.

Smoother agent component: ester (molecular weight of 6,000) of ethylene oxide-propylene oxide copolymer (molecular weight of 2,750) and adipic acid and lauric acid; Extreme-pressure agent component: lauryl (ethylene oxide) diphosphate potassium salt, oleic acid soap; and Surfactant component: octyl alcohol additionally including propylene oxide and ethylene oxide (molecular weight of 1,500).

The thread applied with the oil solution was then taken off to first take-off roll having a surface speed of 721 m/min., and then the thread acquired 1% pre-stretch between the first take-off roll and second take-off roll having a surface speed of 743 m/min. Here the second take-off roll was heated to a temperature of 50° C. in order to pre-heat for drawing process. It should be noted that the pre-stretch of within 3% is carried out for aligning the thread that was taken-off, and thus not correspond to the drawing.

The thread preheated by the second take-off roll was subjected to first drawing process between the second take-off roll and first drawing roll having a surface speed of 2,080 m/min. and a temperature of 140° C., and subjected to second drawing process between the first drawing roll and second drawing roll having a surface speed of 2,600 m/min. and a temperature of 180° C. That is, the yarn was drawn to 2.8 times at the first step, and 1.25 times at the second stage, and thus 3.5 times in total.

The thread after being drawn at the first stage was then crimped by using the heated fluid crimping machine as described in the Japanese Unexamined Patent Application Publication No. 08-269834, and then cooled by a known rotary filter. The heated fluid used herein was heated air having a pressured of 0.78 MPa (8.0 kgf/cm$^2$) and a temperature of 240° C.

The crimped and cooled thread was then subject to a tensile force between a first stretch roll and a second stretch roll, speed of which were adjusted so as to provide a tensile strength of 130 gf, for the purpose of taking up a slack caused by the crimping without having an interrupting winding-up process, and entangled by a known entangling apparatus, and then wound up to a winder at a winding tensile strength of 130 gf.

Thus, obtained was a nylon 6 crimped yarn having: a total fineness of 2,000 decitex; number of single yarns of 96; a single yarn fineness of 21 decitex; a crimp elongation rate after being processed with boiling water of 19.0%; a boiling water shrinkage of 5.2%; a breaking strength of 2.8 cN/decitex; a retention of the breaking strength of 98%; an amount of the adhered oil solution of 0.60%; a yarn-metal kinetic friction coefficient of 0.36; triphyllous ("Y"-shaped) cross sectional shape, a heteromorphic level of 3.3; and number of entangling of 10/m.

The resultant nylon 6 crimped yarn was cheese-dyed and thereafter tufted to a base cloth consisting of aliphatic polyester span bond unwoven cloth, and eventually a level loop cut pile carpet was obtained. The obtained carpet was evaluated on the tufting ability, the luster, the texture, the bulkiness, the compression resistance and the biodegradability. The results of the evaluation of the carpet and the yarn quality of the aforementioned crimped yarn and so on were shown in Table 1.

The Examples 1-13 according to the present invention respectively provided better and satisfactory results on the spinning ability of the crimped yarn and the tufting, the luster, the texture, the bulkiness, the compression resistance and the biodegradability of the carpet.

The comparative example 1 provided the lower crimp elongation rate after being processed with boiling water of 1.8%, which leads to poor texture and poor bulkiness that should be rejected, and thus the result was not satisfactory.

The comparative example 2 provided the lower breaking strength of 0.7 cN/decitex, which leads to poor tufting and poor compression resistance that should be rejected, and thus the result was not satisfactory.

The polymer for the comparative examples 3, and 4 was polyethylene terephthalate and nylon 6, respectively, and therefore the biodegradability was poor, and thus the result was not satisfactory.

Comparative Example 5

A similar method to Example 1 except that a superheated steam having a pressure of 0.78 MPa (8.0 kgf/cm.sup.2) and a temperature of 190.degree. C. was employed for the heated fluid was carried out to obtain a polylactic acid crimped yarn having: a total fineness of 2,000 decitex; number of single yarns of 96; a single yarn fineness of 21 decitex; a crimp elongation rate after being processed with boiling water of 10.2%; a boiling water shrinkage of 6.3%; a breaking strength of 1.2 cN/decitex; a retention of the breaking strength of 84%; an amount of the adhered oil solution of 0.70%; a yarn-metal kinetic friction coefficient of 0.36; triphyllous ("Y"-shaped) cross sectional shape, a heteromorphic level of 3.2; and number of entangling of 10/m.

Then a carpet was obtained by a similar method to Example 1, and the obtained carpet was evaluated on the tufting ability, the luster, the texture, the bulkiness, the compression resistance and the biodegradability. The results of the evaluation of the carpet and the yarn quality of the aforementioned crimped yarn and so on were shown in Table 1.

Comparative Example 6

The thread pre-heated at the second take-of roll was drawn as a first-step drawing between the second take-off roll and the first drawing roll having a surface speed of 2,000 m/min. and a temperature of 80.degree. C., and thereafter the thread was crimped by using the heated fluid crimping machine. That is, a similar method to Example 1 except that the drawing process was a single-step process by carrying out the first drawing step of 2.5 times-drawing was carried out to obtain a polylactic acid crimped yarn having: a total fineness of 2,000 decitex; number of single yarns of 96; a single yarn fineness of 21 decitex; a crimp elongation rate after being processed with boiling water of 8.2%; a boiling water shrinkage of 8.6%; a breaking strength of 1.2 cN/decitex; a retention of the breaking strength of 94%; an amount of the adhered oil solution of 0.60%; a yarn-metal kinetic friction coefficient of 0.37; triphyllous ("Y"-shaped) cross sectional shape, a heteromorphic level of 3.2; and number of entangling of 10/m.

Then a carpet was obtained by a similar method to Example 1, and the obtained carpet was evaluated on the tufting ability, the luster, the texture, the bulkiness, the compression resistance and the biodegradability. The results of the evaluation of the carpet and the yarn quality of the aforementioned crimped yarn and so on were shown in Table 1.

INDUSTRIAL APPLICABILITY

According to the present invention, the aliphatic polyester multifilament crimped yarn having characteristics, in which the mechanical strength required for the carpet and the bulkiness suitable for the carpet can reconcile, which includes comfortable softening sensation, better luster and better color development, and the carpet manufactured thereof, can be obtainable.

In addition, since the fiber and the carpet according to the present invention are composed of aliphatic polyester, the fiber and the carpet are biodegradable in the natural environment.

What is claimed is:

1. A method for producing an aliphatic polyester multifilament crimped yarn, comprising providing a crimp to drawn multifilament fiber including a biodegradable polymer containing an aliphatic polyester as a main component by using a crimp-providing apparatus that utilizes heated air at 120-170° C., to produce a multifilament crimped yarn, wherein the aliphatic polyester multifilament crimped yarn comprises a polylactic acid aliphatic polyester having a melting point equal to or higher than 130° C., said multifilament crimped yarn has a crimp elongation rate of 3-35% after being processed with boiling water, and said multifilament crimped yarn has a breaking strength of 1-5 cN/decitex; and wherein said yarn is produced by drawing a non-drawn yarn via two-step drawing processes, in which the yarn is drawn to 1.01-3 times at the first step and to 1.01-3 times at the second step, with a drawing scale of 1.02-9 times in total.

2. The method for producing said aliphatic polyester multifilament crimped yarn according to claim 1, wherein said crimping process is continuously carried out without a taking-off process in the mid-course thereof.

3. The method for producing said aliphatic polyester multifilament crimped yarn according to claim 1, wherein said aliphatic polyester multifilament crimped yarn is produced by drawing a non-drawn multifilament yarn comprising a biodegradable polymer mainly consists of aliphatic polyester as a main component after pre-heating the filament at a temperature ranging from a glass transition temperature thereof to a temperature of 80° C. higher than the glass transition temperature.

4. The method for producing said aliphatic polyester multifilament crimped yarn according to claim 1, wherein said aliphatic polyester multifilament crimped yarn is produced by adding a non-aqueous oil solution.

* * * * *